US008867960B2

(12) United States Patent
Toda et al.

(10) Patent No.: US 8,867,960 B2
(45) Date of Patent: Oct. 21, 2014

(54) IMAGE FORMING APPARATUS AND PROCESS CARTRIDGE

(71) Applicants: Naohiro Toda, Kanagawa (JP); Takafumi Iwamoto, Shizuoka (JP); Toshihiro Ishida, Shizuoka (JP); Tetsuya Toshine, Shizuoka (JP); Yohta Sakon, Kanagawa (JP); Masahiro Ohmori, Kanagawa (JP)

(72) Inventors: Naohiro Toda, Kanagawa (JP); Takafumi Iwamoto, Shizuoka (JP); Toshihiro Ishida, Shizuoka (JP); Tetsuya Toshine, Shizuoka (JP); Yohta Sakon, Kanagawa (JP); Masahiro Ohmori, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 46 days.

(21) Appl. No.: 13/783,645

(22) Filed: Mar. 4, 2013

(65) Prior Publication Data

US 2013/0243484 A1 Sep. 19, 2013

(30) Foreign Application Priority Data

Mar. 14, 2012 (JP) ..... 2012-057272

(51) Int. Cl.
*G03G 15/00* (2006.01)
*G03G 21/00* (2006.01)

(52) U.S. Cl.
CPC ..... *G03G 21/0017* (2013.01)
USPC ..... 399/159; 399/111; 399/116; 399/123; 399/350

(58) Field of Classification Search
USPC ..... 399/107, 110, 111, 116, 123, 159, 343, 399/350; 430/119.82, 119.84; 15/256.5, 15/256.52
See application file for complete search history.

(56) References Cited

U.S. PATENT DOCUMENTS

| | | | | |
|---|---|---|---|---|
| 7,715,778 | B2 * | 5/2010 | Sugimoto | 399/350 |
| 8,494,429 | B2 * | 7/2013 | Seo et al. | 399/346 |
| 8,543,037 | B2 * | 9/2013 | Egawa et al. | 399/159 |
| 2011/0135361 | A1 | 6/2011 | Kabata et al. | |

FOREIGN PATENT DOCUMENTS

| | | |
|---|---|---|
| JP | 9-127846 | 5/1997 |
| JP | 2004-233818 | 8/2004 |
| JP | 2007-047598 | 2/2007 |
| JP | 2007-086734 | 4/2007 |
| JP | 2010-145793 | 7/2010 |
| JP | 2010-152295 | 7/2010 |
| JP | 2010-191378 | 9/2010 |
| JP | 2010-217224 | 9/2010 |
| JP | 2011-138110 | 7/2011 |
| JP | 2011-145457 | 7/2011 |

* cited by examiner

*Primary Examiner* — Hoan Tran
(74) *Attorney, Agent, or Firm* — Cooper & Dunham LLP

(57) ABSTRACT

An image forming apparatus including an image bearing member having a surface layer A having a surface hardness of 200 N/mm$^2$ or greater, the surface layer A containing fillers made of a metal oxide and a cleaning blade having a reed-like elastic blade having a front edge portion to remove toner from the surface layer A in motion while the front edge portion is in contact with the surface layer A, the front edge portion having a laminate structure formed of a substrate of the elastic blade, a mixed layer of the substrate and an acrylic and/or meth-acrylic resin, the mixed layer having a thickness of 1.0 μm or greater, and a surface layer B having an acrylic and/or meth-acrylic resin, the surface layer B having a thickness of 0.1 μm or greater.

8 Claims, 6 Drawing Sheets

IMAGE FORMING APPARATUS AND PROCESS CARTRIDGE

CROSS-REFERENCE TO RELATED APPLICATION

This patent application is based on and claims priority pursuant to 35 U.S.C. §119 to Japanese Patent Application No. 2012-057272, filed on Mar. 14, 2012, in the Japan Patent Office, the entire disclosure of which is hereby incorporated by reference herein.

BACKGROUND

1. Field

The present invention relates to an image forming apparatus and a process cartridge.

2. Related Art

In a typical electrophotographic image forming apparatus, residual toner remaining on the image bearing member is removed by a cleaning member after a toner image is transferred to a transfer medium or an intermediate transfer element.

Typically, a reed-like cleaning blade is used as such a cleaning member because it has a simple structure and demonstrates good cleaning performance.

Such a cleaning blade is constituted of an elastic material such as polyurethane rubber.

While the base end of the cleaning blade is supported by a supporting member, the front end of the cleaning blade is pressed against the surface of the image bearing member to scrape off the toner remaining on the image bearing member.

Recently, image forming apparatuses using a toner consisting of particles having a nearly spherical form of small particle diameter manufactured by a polymerization method, etc., have been introduced to meet market demand for improvement of image quality.

This polymerized toner has excellent transfer efficiency in comparison with typical toner and is capable of satisfying this demand.

However, the same qualities that make polymerized toner superior to conventional toner also make it difficult to remove the toner from the surface of the image bearing member sufficiently with the cleaning blade.

This problem occurs because the polymerized toner having a nearly spherical form and such a small particle diameter easily slips through a minute gap appearing between the edge of the cleaning blade and the surface of the image bearing member.

One way to prevent such slip-through of the toner is to increase the contact pressure between the image bearing member and the cleaning blade.

However, as described in JP-2010-191378-A and as illustrated in FIG. 8A, by increasing the contact pressure of the cleaning blade, the friction between an image bearing member 123 and a cleaning blade 62 increases so that the cleaning blade 62 is pulled in the moving direction of the image bearing member 123, resulting in turning inward or outward of a front edge portion 62*c* of the cleaning blade 62.

The cleaning blade 62 may then creak when it tries to reacquire its original shape against the turning inward or outward.

Furthermore, if cleaning continues with the front edge portion 62*c* turned inward or outward, the cleaning blade 62 is disproportionally abraded at several μm from the front edge portion 62*c* of a front end surface 62*a* of the cleaning blade 62 as illustrated in FIG. 8B. If this cleaning still continues, the disproportionally abraded portion increases, and finally leads to chipping-off of the front edge portion 62*c* as illustrated in FIG. 8C.

Once part of the front edge portion 62*c* has chipped off, the cleaning blade is no longer capable of removing the toner properly, resulting in poor cleaning performance.

JP-2010-191378-A mentioned above describes a cleaning blade that includes an elastic blade having a low-friction surface made by impregnation of a surface layer with at least one of an isocyanate compound, a fluorine-containing compound, and a silicone compound.

The surface layer covers the front edge portion of the elastic blade and is formed of an ultraviolet-cured resin harder than the elastic blade.

Since the hardness of the front edge portion increases because of the surface layer harder than the elastic blade, it is possible to prevent deformation of the front edge portion in the surface moving direction of the image bearing member.

In addition, if the surface layer is abraded over an extended period of time of use and the front edge portion of the elastic blade is exposed, the impregnated portion of the elastic blade contacts the surface of the image bearing member, thereby reducing the friction between the elastic blade and the image bearing member, which contributes to prevention of deformation of the exposed portion.

In addition, the turning inward and outward of the front edge portion is also reduced and the abrasion resistance of the cleaning blade ameliorates, so that poor cleaning performance is prevented over an extended period of time.

There are other cleaning blades having a hard front edge portion by providing a hard surface layer to the elastic blade.

For example, JP-3602898-B1 (JP-H09-127846-A) describes such a cleaning blade having an elastic blade having a front edge portion covered with a surface layer formed of a resin having a film hardness equivalent to a pencil hardness of from B to 6H. JP-2004-233818-A describes a cleaning blade having an elastic blade having a surface layer harder than the elastic blade, which is provided at least at portions that contact the image bearing member.

The surface layer is formed by impregnating and expanding the elastic blade with an ultraviolet curing material containing silicone followed by ultraviolet irradiation treatment.

However, these cleaning blades having the hardened front edge portions described above find it difficult to sustain good cleaning performance under difficult conditions such as continuous solid image printing, during which an extremely large amount of powder (toner) is attached to the image bearing member.

The inferred failure mechanism is as follows:

The surface layer and the impregnated portion are provided in the longitudinal direction of the front end surface of the elastic blade, which may have an adverse impact on the elasticity of the elastic blade.

If the elasticity of the elastic blade is adversely affected and the image bearing member is decentered or has minute waviness on the surface, the contact pressure of the cleaning blade with the surface of the image bearing member varies in the longitudinal direction.

Consequently, the front edge portion of the cleaning blade becomes unable to maintain suitable contact with the surface of the image bearing member.

When the cleaning blade collects a large quantity of toner while the image forming apparatus is forming solid images continuously, the pressure on the cleaning blade from the toner collected at the cleaning blade increases.

Therefore, if the pressure exerted by the toner on the image bearing member on the cleaning blade surpasses the contact pressure of the cleaning blade, the contact is not sustained at the portions where the contact pressure of the cleaning blade to the image bearing member is low, resulting in slip-through of the toner.

As a result, poor cleaning performance occurs under difficult conditions like continuous solid image printing.

In the structure in which a surface layer harder than an elastic blade is formed after impregnating the urethane rubber elastic blade with an isocyanate compound as described for example in JP-2010-191378-A mentioned above, the isocyanate compound reacts chemically with urethane rubber, so that the cross-linking density of the impregnated portion increases. By having such an impregnated portion, the elastic blade loses its elasticity, which leads to deterioration in the ability of the elastic blade to maintain contact with the image bearing member because of the eccentricity thereof, etc.

Consequently, maintaining good cleaning performance is difficult.

In the structure in which the resin having a pencil hardness of from B to 6H is provided to form the surface layer described in JP-3602898-B1 (JP-H09-127846-A) mentioned above, the abrasion resistance of the surface layer is not sufficient, resulting in quick disappearance of the surface layer due to the abrasion with the image bearing member.

If the surface layer is made thicker, the elasticity of the elastic blade decreases and the ability of the blade to maintain contact with the image bearing member in the face of the variation caused by eccentricity of the image bearing member, etc. deteriorates, resulting in poor cleaning performance.

In addition, the structure described in JP-2004-233818-A mentioned above, which is formed by impregnating and expanding the elastic blade with an ultraviolet curing material containing silicone followed by ultraviolet irradiation treatment to provide a surface layer harder than the elastic blade to the contact portion with the image bearing member, requires impregnation with a large amount of the ultraviolet curing material to sufficiently harden the surface layer.

However, if the elastic blade is impregnated with a large amount of the ultraviolet curing material, the ultraviolet curing material inside the elastic blade increases, thereby forming an excessively hard and deep impregnated portion, which leads to deterioration of the elasticity of the elastic blade.

Consequently, the ability of the front edge portion of the blade to maintain contact with the surface of the image bearing member deteriorates, resulting in poor cleaning performance.

In addition, with a cleaning blade having a front edge portion harder than the elastic blade, the surface of the image bearing member tends to be abraded sooner than with an elastic blade, which leads to background fouling and other image quality problems.

JP-2010-191378-A mentioned above also describes an image forming apparatus using an image bearing member having a surface layer formed of a cross-linking type charge transport material.

The cleaning blade having a front edge portion harder than the elastic blade contacts the image bearing member.

However, this image forming apparatus is just a combination of the cleaning blade and the image bearing member, both of which have improved mechanical durability.

Since contact between the hard layers with friction causes abrasion of the cleaning blade and/or the image bearing member, cleaning performance deteriorates over an extended period of time.

Furthermore, since the cleaning blade having a hard front edge portion presses toner against the surface of the image bearing member and the surface of the image bearing member is hard to wear down, silica particles externally added to the toner are attached to and fixed on the surface of the image bearing member due to the pressure and friction heat generated by such hard contact, which is referred to as filming of the image bearing member.

Filming of the image bearing member leads directly to production of defective images.

SUMMARY

In view of the foregoing, the present invention provides an image forming apparatus including an image bearing member having a surface layer A having a surface hardness of 200 $N/mm^2$ or greater, the surface layer A containing fillers made of a metal oxide and a cleaning blade having a reed-like elastic blade having a front edge portion to remove toner from the surface layer A m motion while the front edge portion is in contact with the surface layer A, the front edge portion having a laminate structure formed of a substrate of the elastic blade, a mixed layer of the substrate and an acrylic and/or methacrylic resin, the mixed layer having a thickness of 1.0 μm or greater, and a surface layer B having an acrylic and/or methacrylic resin, the surface layer B having a thickness of 0.1 μm or greater.

As another aspect of the present invention, a process cartridge detachably attachable to an image forming apparatus is provided, the process cartridge including an image bearing member having a surface layer A having a surface hardness of 200 $N/mm^2$ or greater, the surface layer A containing fillers made of a metal oxide and a cleaning blade having a reed-like elastic blade having a front edge portion to remove toner from the surface layer A in motion while the front edge portion is in contact with the surface layer A, the front edge portion having a laminate structure formed of a substrate of the elastic blade, a mixed layer of the substrate and an acrylic and/or methacrylic resin, the mixed layer having a thickness of 1.0 μm or greater, and a surface layer B having an acrylic and/or methacrylic resin, the surface layer B having a thickness of 0.1 μm or greater.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein:

FIGS. 2A and 2B are cross-sectional views of an example of a cleaning blade, in which FIG. 2A is a diagram illustrating the cleaning blade in contact with the surface of the image bearing member and FIG. 2B is an enlarged diagram illustrating portions around the front edge portion of the cleaning blade;

DETAILED DESCRIPTION

Figure 1:
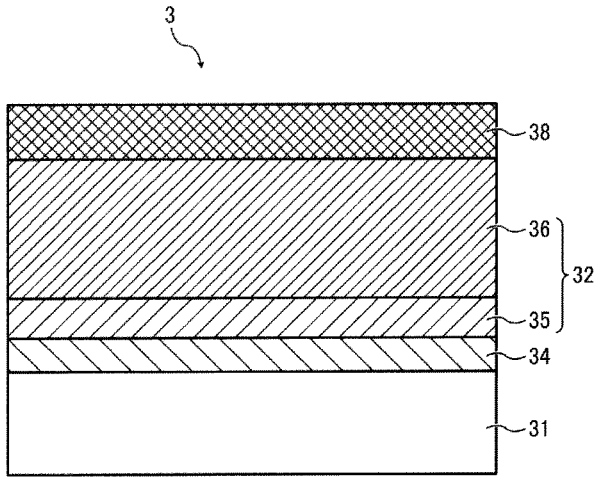
FIG. 1 is a diagram illustrating the layer structure of an example of the image bearing member of the present disclosure.

The present inventors have found a combination of the condition of the material and the thickness of the front edge portion of a cleaning blade and the condition of the surface of an image bearing member to reduce the occurrence of the image bearing member filming in addition to improvement of the contact between the front edge portion of the cleaning blade and the image bearing member to maintain good cleaning performance while reducing abnormal abrasion, creaky noise, and turning inward or outward of the front edge portion of the cleaning blade over a more extended period of time and provide an image forming apparatus having an image bearing member and a cleaning blade having an elastic blade having a reed-like shape with its front edge portion contacting with the moving surface of the image bearing member.

The surface of the image bearing member contains fillers formed of a metal oxide and has a surface hardness of 200 ($N/mm^2$) or higher and the front edge portion of the cleaning blade has a laminate structure having a substrate of the elastic blade, a mixed layer having a thickness of 1.0 μm or more formed by the substrate and an acrylic resin and/or a methacrylic resin, and a surface layer having a thickness of 0.1 μm or more formed of an acrylic resin and/or a methacrylic resin.

In the present disclosure, as seen in the experimental results shown later, by using the image bearing member having the surface layer described above and the cleaning blade having the front edge portion described above, it is possible to sustain a good cleaning performance while reducing abnormal abrasion, creaky noise, and turning inward or outward of the front edge portion of the cleaning blade over a more extended period of time in addition to improvement of the contact between the front edge portion of the cleaning blade and the image bearing member.

In addition, the filming on the surface of the image bearing member is also reduced.

The inferred mechanism is as follows:

Since the image bearing member contains fillers formed of a metal oxide in the surface layer to improve the mechanical strength of the image bearing member, the durability ameliorates and the surface of the image bearing member has minute roughness.

Since the surface of the image bearing member has such minute roughness, the friction force between the image bearing member and the front edge portion of the cleaning blade is reduced in comparison with a case in which an image bearing member having a smooth surface is used.

Consequently, the abrasion of the surface of the image bearing member and the front edge portion of the cleaning blade are reduced, which makes it possible to keep a good cleaning performance.

In addition, the friction heat is less generated, which is advantageous in terms of the filming on image bearing member filming.

However, when the surface hardness of the surface layer of the image bearing member is too small, the abrasion reduction capability of the surface layer of the image bearing member tends to be insufficient, which leads to insufficient durability.

In addition, the toner component pressed against by the cleaning blade tends to be buried in the surface layer of the image bearing member, which is disadvantageous in terms of the filming on image bearing member filming.

Consequently, it is suitable that the surface hardness of the surface layer of the image bearing member is 200 ($N/mm^2$) or higher.

Furthermore, the acrylic resin and/or the methacrylic resin for use in the surface layer of the cleaning blade are more durable than the resins typically used for the surface layer.

Also, since both the surface layer and the mixed layer contain an acrylic resin and/or a methacrylic resin, the acrylic resin and/or the methacrylic resin in the mixed layer exhibits so-called anchor effect to the acrylic resin and/or the methacrylic resin in the surface layer, thereby increasing the adhesion between the surface layer and the elastic blade.

This is inferred to contribute to further improvement of the durability of the surface layer. In addition, the acrylic resin and/or the methacrylic resin to form the mixed layer conduct cross-linking reaction without chemically bonding with the elastic blade in comparison with a typically-used isocyanate compound.

As a result, the cross-linking density of the mixed layer excessively increases, which removes the concern about the decrease of the elasticity of the elastic blade.

The surface layer and the mixed layer that contain the acrylic resin and/or the methacrylic resin with the predetermined thicknesses provide the cleaning blade having a good combination between reduction of the deformation of the front edge portion of the cleaning blade in the surface moving direction of the image bearing member, creaky noises, and turning inward or outward of the front edge portion and the contact between the image bearing member and the cleaning blade.

Furthermore, by bringing the cleaning blade into contact with the image bearing member having the surface layer containing fillers made of a metal oxide and having a surface hardness of 200 ($N/mm^2$) or higher, the occurrence of filming on the surface of the image bearing member is suppressed while reducing the abrasion of the image bearing member.

An embodiment of the electrophotographic image forming apparatus to which the present disclosure is applied is described next.

The image bearing member for use in the image forming apparatus is described first.

FIG. 1 is a schematic cross section illustrating an example of the layer structure of this embodiment.

The image bearing member 3 has a photosensitive layer 32 on a substrate 31 and a surface protection layer 38 having excellent abrasion resistance as the uppermost surface layer.

The photosensitive layer 32 has a feature-separating laminate structure in which a charge generation layer 35 is laminated on a charge transport layer 36.

In addition, optionally, an undercoating layer 34 is provided between the substrate 31 and the photosensitive layer 32.

There is no specific limit to the layer structure of the image bearing member 3.

The image bearing member 3 has the substrate 31 and at least the photosensitive layer 32 and the surface protection layer 38 overlying the substrate 31 in this order with the optional undercoating layer 34.

Surface Protection Layer

The surface protection layer 38 (surface layer A) in the image bearing member 3 contains fillers made of a metal oxide and has a surface hardness of 200 ($N/mm^2$).

This makes it possible to obtain a strong durability and a good cleaning property simultaneously.

The mechanism of the effective feature of the surface protection layer 38 that contains fillers made of a metal oxide and has a surface hardness of 200 ($N/mm^2$) or higher is not clear but inferred as follows:

By containing the fillers made of a metal oxide in the surface protection layer 38, the durability of the surface protection layer 38 improves and the surface of the image bearing member becomes rough.

Consequently, minute nipping portions appear between the image bearing member 3 and a cleaning blade 62.

As a result, relative to a case of an image bearing member having a smooth surface, the friction between the surface protection layer 38 of the image bearing member and the hard front edge portion of the cleaning blade 62 is reduced, thereby reducing the abrasion of the surface protection layer 38 and the front edge portion of the cleaning blade 62.

In addition, less frictional heat is generated, which is advantageous in terms of preventing filming of image bearing member.

However, when the surface hardness of the surface protection layer 38 is insufficient, the reduction of abrasion by the surface protection layer 38 tends to be insufficient, which leads to poor durability.

The silica particles used as an external additive for the toner pressed against the image bearing member by the cleaning blade tend to be buried in the surface protection layer 38 of the image bearing member 3, which causes the image bearing member filming. Consequently, it is suitable that the surface hardness of the surface protection layer 38 of the image bearing member 3 is 200 ($N/mm^2$) or higher.

The surface hardness can be measured by a micro-hardness measurement system (FISCHERSCOPE® HM2000, manufactured by FISCHER TECHNOLOGY INC.) as Martens hardness when pressing a Vickers indenter to the surface of the image bearing member 3 under a load of 1 mN.

When the volume content ratio of the filler contained in the surface protection layer 38 ranges from 10% to 40%, a rough surface that improves the surface hardness and provides good cleaning property can be formed on the image bearing member.

An excessively small amount of the filler is incapable of providing a high surface hardness to the surface of the image bearing member 3.

Consequently, the surface roughness is not formed on the surface of the image bearing member 3, resulting in quick abrasion of the image bearing member and degradation of cleaning performance.

When the volume content ratio of the filler is too high, the roughness of the surface of the image bearing member tends to increase excessively, so that the front edge portion of the cleaning blade 62 is not held on the surface of the image bearing member 3 stably, thereby degrading cleaning performance.

The volume content ratio can be obtained as the component ratio of the filler contained in the surface protection layer 38 by observing the cross section of the surface protection layer 38 by an FE-SEM with a magnifying power of 10,000.

When the particle diameter of the filler contained in the surface protection layer 38 ranges from 10 nm to 100 nm, the roughness that improves the surface hardness and provides good cleaning property can be formed on the image bearing member.

When the particle diameter of the filler is too small, the obtained surface hardness is not high or the roughness of the surface of the image bearing member 3 is not formed, resulting in quick abrasion of the image bearing member and degradation of cleaning performance.

When the particle diameter of the filler is too large, the roughness of the surface of the image bearing member tends to increase excessively, so that the front edge portion of the cleaning blade 62 may not be held on the surface of the image bearing member 3 stably, thereby degrading cleaning performance.

The particle diameter of the filler made of a metal oxide represents the average primary particle diameter and can be obtained by calculating the average of ten particles with regard to the average of the major axis and minor axis of the metal oxide particle observed by a scanning electron microscope (SEM) or a transmission electron microscope (TEM).

Specific examples of the filler of the metal oxide contained in the surface protection layer 38 include, but are not limited to, titanium oxide, silica, tin oxide, alumina, zirconium oxide, indium oxide, calcium oxide, and zinc oxide.

The filler of the metal oxide may be subject to surface treatment by an inorganic or organic material to improve the dispersability, etc.

Specific examples of the organic material treatment include, but are not limited to, treatment by a silane coupling agent, treatment by a fluorine-containing silane coupling agent, and treatment by a higher aliphatic acid.

Specific examples of the inorganic material treatment include, but are not limited to, treatment of the surface of the metal oxide with alumina, zirconia, tin oxide, or silica.

The filler of the metal oxide is pulverized and dispersed and thereafter mixed with a liquid application of the surface protection layer followed by application.

The surface protection layer 38 is preferably formed by at least polymerization of a polymerizable compound. In light of the mechanical durability, it is preferable to use a polymerizable compound having at least three polymerizable functional groups in the molecule.

When a polymerizable monomer having at least three functional groups is polymerized, a three dimensional network structure is developed and thus a surface protection layer having a high hardness with an extremely high density and a high elasticity is obtained. In addition, the layer exhibits a high abrasion resistance and damage resistance.

Among the polymerizable monomers having at least three functional groups, a polymerizable compound having a functional group equivalent molecular weight of 350 or less is preferable because the three dimensional network structure particularly develops.

There is no specific limit to the kind of the curing resin.

Specific examples thereof include, but are not limited to, amino resins, urethane resins, epoxy resins, phenolic resins, silicone resins, and acrylic resins.

Among these, ultraviolet curing type acrylic resins having at least three radical polymerizable monomers are particularly preferable in terms of abrasion resistance.

Specific examples of the radical polymerizable monomers having at least three functional groups include, but are not limited to, trimethylol propane triacrylate (TMPTA), trimethylol propane trimethacrylate, trimethylol propane alkylene modified triacrylate, trimethylol propane ethyleneoxy modified triacrylate, trimethylol propane propyleneoxy modified triacrylate, trimethylol propane alkylene modified triacrylate, pentaerythritol triacrylate, pentaerythritol tetra acrylate (PETTA), glycerine propoxy triacrylate, tris(acryloxy ethyl)isocyanulate, dipenta erythritol hexacrylate (DPHA), dipenta erythritol caprolactone modified hexacrylate, dipenta erythritol hydroxyl dipenta acrylate, alkylized dipenta erythritol pentaacrylate, alkylized dipenta erythritol tetraacrylate, alkylized dipenta erythritol triacrylate, ditrimethylol propane tetracrylate (DTMPTA), and penta erythuritol ethoxy tetracrylate.

These materials can be used alone or in combination.

When forming the surface protection layer 38, it is possible to contain a charge transport material (which is not necessary but preferable to have a polymerizable functional group in light of the mechanical durability) in addition to the polymerizable compound mentioned above.

A less number of the functional groups is preferable in terms of the distortion of the curable resin structure and the internal stress of the cross-linking surface layer and a charge transport compound having a functional group is suitably usable.

Specific examples of dispersing solvent that can be used as a liquid application of the surface protection layer 38 include, but are not limited to, ketones, ethers, aromatic compounds, halogen compounds, and esters.

Among these solvents, methyl ethyl ketone, tetrahydrofuran, and cyclohexanone are preferable to chloeobenzene, dichloromethane, toluene, and xylene in terms of burden on the environment.

In addition, a polymerization initiator can be optionally added to accelerate the curing reaction in the present disclosure.

The polymerization initiators include thermal polymerization initiators and photopolymerization initiators.

Specific examples of the thermal polymerization initiators include, but are not limited to, peroxide based initiators such as 2,5-dimethyl hexane-2,5-dihydroperoxide, dicumyl peroxide, benzoyl peroxide, t-butylcumyl peroxide, 2,5-dimethyl-2,5-di(peroxybenzoyl)hexine-3, di-t-butyl peroxide, t-butylhydro peroxide, cumnenehydro peroxide, lauroyl peroxide, and 2,2-bis(4,4-di-t-butylperoxy cyclohexy)propane; and azo based initiators such as azobis isobutyl nitrile, azobis cyalohexane carbonitrile, azobis iso methyl butyrate, azobis isobutyl amidine hydrochloride, and 4,4'-azobis-4-cyano valeric acid.

Specific examples of photopolymerization initiators include, but are not limited to, acetophenon based or ketal based photopolymerization initiators such as diethoxy acetophenone, 2,2-dimethoxy-1,2-diphenyl ethane-1-on, 1-hydroxy-cyclohexyl-phenyl-ketone, 4-(2-hydroxyethoxy) phenyl-(2-hydroxy-2-propyl)ketone, 2-benzyl-2-dimethylamino-1-(4-morpholinophenyl)butanone-1,2-hydroxy-2-methyl-1-phenyl propane-1-on, and 1-phenyl-1,2-propane dion-2-(o-ethoxycarbonyl)oxime; benzoine ether based photopolymerization initiators such as benzoine, benzoine methyl ether, benzoine ethyl ether, benzoine isobutyl ether, and benzoine isopropyl ether, benzophenone based photopolymerization initiators such as benzophenone, 4-hydroxy benzophenone, o-benzoyl methyl benzoate, 2-benzoyl naphthalene, 4-benzoyl biphenyl, 4-benzoyl phenyl ether, acrylized benzophenone, and 1,4-benzoyl benzene; and thioxanthone based photopolymerization initiators such as 2-isopropyl thioxanthone, 2-chlorothioxanthone, 2,4-dimethyl thioxanthone, 2,4-diethyl thioxanthone, and 2,4-dichloro thioxanthone.

Specific examples of the other photopolymerization initiators include, but are not limited to, ethyl anthraquinone, 2,4,6-trimethyl benzoyl diphenyl phosphine oxide, 2,4,6-trimethyl benzoyl phenyl ethoxy phosphine oxide, bis(2,4,6-trimethyl benzoyl)phenyl phosphine oxide, bis(2,4-dimethoxybenzoyl)-2,4,4-trimethyl pentyl phosphine oxide, a methylphenyl glyoxy ester, 9,10-phenanthrene, an acridine based compound, a triadine based compound and an imidazole based compound.

These materials can be used alone or in combination.

In addition, a compound having an acceleration effect on photopolymerization can be used alone or in combination with the photopolymerization initiator. Specific examples of such compounds include, but are not limited to, triethanol amine, methyl diethanol amine, 4-dimethyl amino ethyl benzoate, 4-dimethyl amino isoamyl benzoate, ethyl benzoate (2-dimethyl amino), and 4,4'-dimethyl amino benzophenone.

The content of the polymerization initiator is preferably from 0.1 parts by weight to 40 parts by weight and more preferably from 0.5 parts by weight to 20 parts by weight based on 100 parts by weight of the material containing a polymerizable functional group In addition, low molecular weight compounds such as an anti-oxidant, a plasticizing agent, a lubricant, and an ultraviolet absorber and a leveling agent can be added, if desired. These compounds may be used alone or in combination.

The content of the low molecular weight compounds is preferably from 0.1 parts by weigh to 50 parts by weight and more preferably from 0.1 parts by weigh to 20 parts by weight based on 100 parts of the resin component. The content of the leveling agent is suitably from 0.001 parts by weigh to 5 parts by weight based on 100 parts by weight of the resin component.

To form the surface protection layer 38, a liquid application is applied by, for example, a dip coating method, a spray coating method, a ring coating method, a roll coater method, a gravure application method, a nozzle coating method, and a screen printing method and thereafter cured by an external energy.

The external energy applied during formation of the surface protection layer is, for example, heat, light, and radiation and is selected according to the selected resin.

Heat can be applied to the protection layer from the application surface side or the substrate side using a gas such as air and nitrogen, vapor, or various kinds of heat media, infra-red radiation and electromagnetic wave.

The heating temperature is preferably from 100° C. to 170° C.

A heating temperature that is too low tends to slow down the reaction speed, so that the reaction my not complete.

A hating temperature that is too high tends to conduct non-uniform curing reaction, which leads to significant distortion of the inside of the surface protection layer and occurrence of a great number of non-reacted residual groups and reaction terminated ends.

A method of heating the cross linked surface layer at a relatively low temperature, for example lower than 100° C., followed by eating at a relatively high temperature, for example, 100° C. or higher, is suitable to uniformly proceed the curing reaction.

As light energy, a UV irradiation light source such as a high pressure mercury lamp or a metal halide lamp having an emission wavelength mainly in the ultraviolet area is used.

A visible light source can be selected according to the absorption wavelength of a radical polymerizable compound and a photopolymerization initiator.

The irradiation amount is preferably from 50 $mW/cm^2$ to 1,000 $mW/cm^2$.

An irradiation light amount that is too small tends to slow down the curing reaction speed.

An irradiation light amount that is too large tends to prevent a uniform curing reaction speed, which results in local wrinkling on the surface of the protection layer and causes a great number of non-reacted residual groups and reaction terminated ends.

In addition, rapid cross-linking increases the internal stress, which leads to cracking and peeling-off of the layer. Beams of electron can be used as the radiation ray energy.

Among these forms of energies, thermal or photo energy is suitably used in terms of easiness of reaction speed control and simplicity of the device.

The surface protection layer 38 preferably has a thickness of from 0.5 μm to 7 μm and particularly preferably from 0.8 μm to 5 μm in terms of the durability of the surface protection layer 38 and the resolution quality.

Photosensitive Layer

As the photosensitive layer 32, the laminar photosensitive layer in which the charge generation layer 35 and the charge transport layer 36 are laminated in this sequence is preferable.

Charge Generation Layer

The charge generation layer 35 represents part of the laminar photosensitive layer, has a feature of generating charges upon irradiation of light, contains a charge generating material as the main component and optionally a binder resin.

Charge Generating Material

Inorganic materials and organic materials can be used as the charge generating material.

There is no specific limit to the inorganic materials.

Specific examples of the inorganic materials include, but are not limited to, crystal selenium, amorphous-selenium, selenium-tellurium-halogen, selenium-arsenic compounds, and amorphous-silicon.

With regard to the amorphous-silicon, those in which a dangling-bond is terminated with a hydrogen atom or a halogen atom and those in which boron atoms or phosphorous atoms are doped are preferably used.

There is no specific limit to the organic materials and known materials can be used. Specific examples thereof include, but are not limited to, metal phthalocyanine such as titanyl phthalocyanine and chloropotassium phthalocyanine; metal-free phthalocyanine; azulenium salt pigments; squaric acid methine pigments; symmetric or asymmetric azo pigments having a carbazole skeleton; symmetric or asymmetric azo pigments having a triphenylamine skeleton; symmetric or asymmetric azo pigments having a diphenylamine skeleton; symmetric or asymmetric azo pigments having a dibenzothiophene skeleton; symmetric or asymmetric azo pigments having a fluorenone skeleton; symmetric or asymmetric azo pigments having an oxadiazole skeleton; symmetric or asymmetric azo pigments having a bis-stilbene skeleton; symmetric or asymmetric azo pigments having a distilyloxadiazole skeleton; symmetric or asymmetric azo pigments having a distylylcarbazole skeleton; perylene pigments, anthraquinone or polycyclic quinone pigments; quinoneimine pigments; diphenylmethane and triphenylmethane pigments; benzoquinone and naphthoquinone pigments; cyanine and azomethine pigments, indigoid pigments, and bisbenzimidazole pigments. These materials can be used alone or in combination.

Among these, metal phthalocyanine, symmetric or asymmetric type azo pigments having a fluorenone skeleton, symmetric or asymmetric type azo pigments having a triphenylamine skeleton, and perylene pigments are suitable as the materials for use in the present disclosure because they have excellent quantum efficiency of charge generation.

Binder Resin

There is no specific limit to the binder resin for use in the charge generation layer 35.

Specific examples of the binder resin include, but are not limited to, polyamides, polyurethanes, epoxy resins, polyketones, polycarbonates, silicone resins, acrylic resins, polyvinylbutyrals, polyvinylformals, polyvinylketones, polystyrenes, poly-N-vinylcarbazoles, and polyacrylamides.

These materials can be used alone or in combination.

Among these, polyvinyl butyral is preferably used.

The methods of forming the charge generation layer 35 are largely classified into the vacuum thin layer forming methods and the casting methods from a solution dispersion system.

Specific examples of the vacuum thin layer formation methods include, but are not limited to a vacuum evaporation method, a glow discharge decomposition method, an ion-plating method, a sputtering method, a reactive sputtering method, or a CVD (chemical vapor deposition) method.

A layer of the inorganic material and organic material specified above can be suitably formed.

In the casting method, the above-mentioned inorganic or organic charge generation material is dispersed with an optional binder resin in a solvent, for example, tetrahydrofuran, dioxane, cyclohexanone, dioxsan, ichloroethane, and butanone using, for example, a ball mill, an attritor, and a sand mill.

Thereafter, the resultant liquid dispersion is suitably diluted for application.

Among these solvents, methyl ethyl ketone, tetrahydrofuran, and cyclohexanone are preferable to chloeobenzene, dichloromethane, toluene, and xylene in terms of burden on the environment.

A dip coating method, a spray coating method, a bead coating method, etc., can be used for application.

The charge generation layer preferably has a thickness of from 0.01 μm to 5 μm and more preferably from 0.05 μm to 2 μm.

Charge Transport Layer

The charge transport layer 36 is part of the laminar photosensitive layer and has features of infusing and transporting the charges generated in the charge generation layer 35 and neutralizing the surface charge of the image bearing member.

The charge transport layer 36 contains at least a charge transport material, a binder resin, and other optional materials.

The charge transport layer 36 can be formed by dissolving or dispersing the charge transport material and the binder resin in a suitable solvent followed by coating and drying.

Known methods such as a dip coating method, a spray coating method, a ring coating method, a roll coater method, a gravure coating method, a nozzle coating method, and a screen printing method can be used as the application method.

The thickness of the charge transport layer 36 is preferably from 15 μm to 40 μm, more preferably from 15 μm to 30 μm, and particularly preferably from 15 μm to 25 μm for a higher resolution to practically secure the sensitivity and the charging power.

Since the surface protection layer 38 is laminated on the charge transport layer 36, it is not required to increase the thickness of the charge transport layer in this structure to compensate the film scraping during actual use, which makes it possible to form a thin charge transport layer.

Specific examples of the dispersing solvents to prepare the liquid application of the charge transport layer include, but are not limited to, ketone-based solvents such as methylethyl ketone, acetone, methylisobutyl ketone, and cyclohexanone; ether-based solvents such as dioxane, tetrahydrofuran, and ethylcellosolve; aromatic solvents such as toluene and xylene; halogens such as chlorobenzene and dichloromethane; and esters such as ethyl acetate and butyl acetate.

These materials can be used alone or in combination.

Among these solvents, methyl ethyl ketone, tetrahydrofuran, and cyclohexanone are preferable to chloebenzene, dichloromethane, toluene, and xylene in terms of burden on the environment.

Binder Component

There is no specific limit to the polymer usable as the binder component of the charge transport layer 36.

Specific examples thereof include, but are not limited to, a polystyrene, a styrene-acrylonitrile copolymer, a styrene-butadiene copolymer, a styrene-maleic anhydride copolymer, a polyester, a polyvinyl, a polyvinyl chloride, a vinyl chloride-vinyl acetate copolymer, a polyvinyl acetate, a polyvinylidene chloride, a polyarylate resin, polycarbonate, a cellulose acetate resin, an ethyl cellulose resin, a polyvinyl butyral, a polyvinyl formal, a polyvinyl toluene, an acrylic resin, a silicone resin, a fluorine resin, an epoxy resin, a melamine resin, a methane resin, a phenolic resin, and an alkyd resin.

These charge transport polymers can be used alone, in combination, as copolymers of at least two kinds of raw material monomers therefor, or as compounds obtained by copolymerization with the charge transport materials.

Among these, polystyrenes, polyesters, polyarylates, or polycarbonates are preferably used as the binder component for the charge transport component because these have good charge mobility.

The charge transport layer 36 of the present disclosure is not required to have the mechanical strength for a typical charge transport layer because the surface protection layer 38 is laminated on the charge transport layer 36.

Therefore, materials such as polystyrene which have a high transparency with a relatively weak mechanical strength and are not suitable in typical cases can be used as the binder component for the charge transport layer 36.

Charge Transport Material

The charge transport material is classified into a positive hole transport material and an electron transport material.

Specific examples of such electron transport material include, but are not limited to, electron acceptance material such as chloranil, bromanil, tetracyano ethylene, tetracyanoquino dimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrdibenzothhiophene-5,5-dioxide, and benzoquinone derivatives.

Specific examples of the positive hole transport materials include, but are not limited to, poly-N-vinylvarbazole) and derivatives thereof, poly-γ-carbzoyl ethylglutamate) and derivatives thereof, pyrenne-formaldehyde condensation products and derivatives thereof, polyvinylpyrene, polyvinyl phnanthrene, polysilane, oxazole derivatives, oxadiazole derivatives, imidazole derivatives, monoaryl amine derivatives, diaryl amine derivatives, triaryl amine derivatives, stilbene derivatives, α-phenyl stilbene derivatives, benzidine derivatives, diaryl methane derivatives, triaryl methane derivatives, 9-styryl anthracene derivatives, pyrazoline derivatives, divinyl benzene derivatives, hydrazone derivatives, indene derivatives, butadiene derivatives, pyrene derivatives, bisstilbene derivatives, and enamine derivatives.

These charge transport material can be used alone or in combination.

In addition, low molecular weight compounds such as an antioxidant, a plasticizing agent, a lubricant, and an ultraviolet absorber and a leveling agent can be added to the charge transport layer, if desired. These compounds may be used alone or in combination.

However, a combinational use of the low molecular weight compound and the leveling agent may cause deterioration of the sensitivity.

The content of the low molecular weight compound is preferably from 0.1 parts by weight to 20 parts by weight and more preferably from 0.1 parts by weight to 10 parts by weight based on 100 parts by weight of the resin contained in the charge transport layer.

The content of the leveling agent is preferably from 0.001 parts by weight to 0.1 parts by weight.

Substrate

There is no specific limit to the electroconductive substrate 31 as long as the material has a volume resistance of not greater than $10\times10^{10}$ Ω·cm.

For example, there can be used plastic or paper having a film form or cylindrical form covered with a metal such as aluminum, nickel, chrome, nichrome, copper, gold, silver, and platinum, or a metal oxide such as tin oxide and indium oxide by depositing or sputtering.

Also a board formed of aluminum, an aluminum alloy, nickel, and a stainless metal can be used.

Further, a tube which is manufactured from the board mentioned above by a crafting technique such as extruding and extracting and surface-treatment such as cutting, super finishing, and grinding is also usable.

In addition, an endless nickel belt and an endless stainless belt described in JP-S52-36016-A can be used as the electroconductive substrate.

A substrate formed by applying to the substrate mentioned above a liquid application in which electroconductive powder is dispersed in a suitable binder resin can be also suitably used as the substrate.

Specific examples of such electroconductive powder include, but are not limited to, carbon black, acetylene black, metal powder, such as powder of aluminum, nickel, iron, nichrome, copper, zinc and silver, and metal oxide powder, such as electroconductive tin oxide powder and ITO powder.

Specific examples of the binder resin used simultaneously include, but are not limited to, polystyrene resins, copolymers of styrene and acrylonitrile, copolymers of styrene and butediene, copolymers of styrene and maleic anhydrate, polyesters resins, polyvinyl chloride resins, copolymers of a vinyl chloride and a vinyl acetate, polyvinyl acetate resins, polyvinylidene chloride resins, polyarylate resins, phenoxy resins, polycarbonate reins, cellulose acetate resins, ethyl cellulose resins, polyvinyl butyral resins, polyvinyl formal resins, polyvinyl toluene resins, poly-N-vinylcarbozole, acrylic resins, silicone resins, epoxy resins, melamine resins, urethane resins, phenolic resins, and alkyd resins. These materials can be used alone or in combination.

Such an electroconductive layer can be formed by dispersing the electroconductive powder and the binder resins mentioned above in a suitable solvent, for example, tetrahydrofuran (THF), dichloromethane (MDC), methyl ethyl ketone (MEK), and toluene and applying the resultant to an electroconductive substrate.

In addition, an electroconductive substrate formed by providing a heat contraction tube as an electroconductive layer on a suitable cylindrical substrate can be used as the substrate in the present disclosure.

The heat contraction tube is formed of materials such as polyvinyl chloride, polypropylene, polyester, polystyrene, polyvinylidene chloride, polyethylene, chloride rubber, and TEFLON®, which contains the electroconductive powder mentioned above.

Undercoating Layer

The image bearing member 3 may have an undercoating layer 34 between the substrate 31 and the photosensitive layer 32.

Typically, the undercoating layer 34 is mainly made of a resin.

Considering that a liquid application of the photosensitive layer 32 is applied to the undercoating layer 34, the resin is preferably not or little soluble in a known organic solvent.

Specific examples of such resins include, but are not limited to, water-soluble resins such as polyvinyl alcohol, casein, and sodium polyacrylate; alcohol-soluble resins such as copolymerized nylon, and methoxymethylated nylon; and curing resins forming three-dimensional structure such as polyurethane, melamine resins, alkyd resins, melamine resins, and epoxy resins.

In addition, fine powder of metal oxides such as titanium oxide, silica, alumina, zirconium oxide, tin oxide, and indium oxide, metal sulfides, and metal nitrides can be optionally added as fillers in the undercoating layer to furthermore maintain the stability of the chargeability.

The undercoating layer 34 described above can be formed by using a suitable solvent and a suitable coating method.

The undercoating layer 34 preferably has a thickness of 10 μm or less and more preferably from 0.2 μm to 6 μm.

In addition, the image bearing member 3 may have an intermediate layer on the substrate 31. The intermediate layer is mainly made of a resin.

Considering that a liquid application of the photosensitive layer 32 is applied to the intermediate layer, the resin is preferably not or little soluble in a known organic solvent. The same resins as those for the undercoating layer 34 are selectable.

In the image bearing member 3, an anti-oxidant, a plasticizer, a lubricant, an ultraviolet absorber, a low molecular weight change transport material, a leveling agent, etc. can be added to each of the charge generation layer 35, the charge transport layer 36, the undercoating layer 34, the surface protection layer 38, etc. to improve the environmental resistance, particularly to prevent the degradation of sensitivity and the rise in residual potential.

Next, the cleaning blade 62 for use in the image forming apparatus is described.

In the image forming apparatus of the present disclosure, the cleaning blade 62 has an elastic blade having a reed-like shape and a contact portion (front edge portion) with the image bearing member.

The front edge portion has a laminar structure having a substrate of the elastic blade, a mixed layer having a thickness of 1.0 μm or more formed of the substrate and an acrylic resin and/or a methacrylic resin, and a surface layer having a thickness of 0.1 μm or more formed of an acrylic resin and/or a methacrylic resin.

Using such a cleaning blade, both the image bearing member and the cleaning blade have a strong durability and contribute to producing quality images.

Figure 2A:
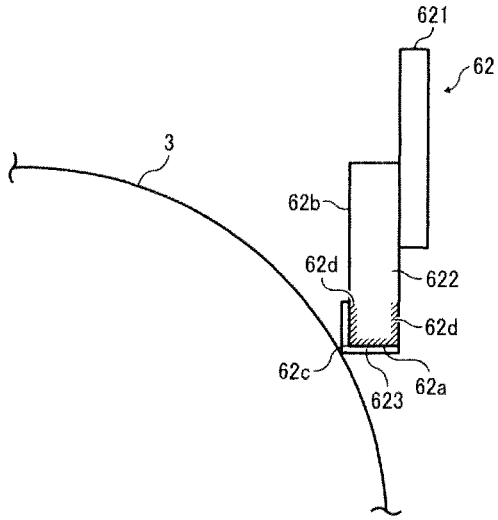
Figure 2B:
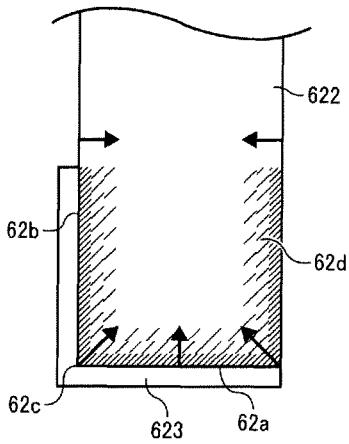

FIG. 2 is an enlarged cross-section of the cleaning blade 62. FIG. 2A is a diagram illustrating the state in which the cleaning blade 62 is in contact with the surface of the image bearing member 3 and FIG. 2B is an enlarged diagram illustrating portions around the front edge portion 62*c* of the cleaning blade 62.

Figure 5:
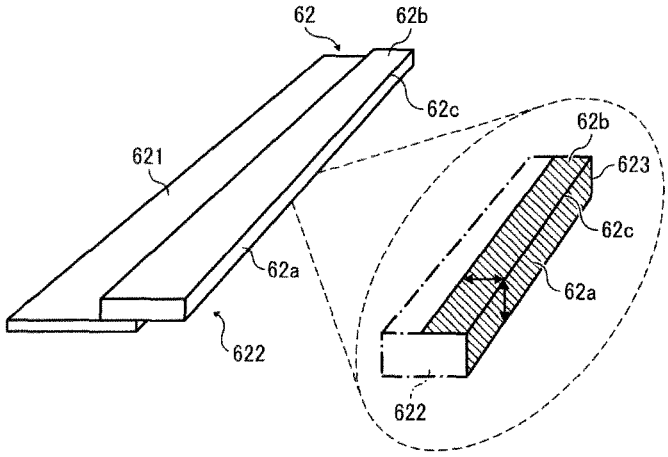
FIG. 5 is a perspective diagram illustrating an example of the cleaning blade of the present disclosure.

FIG. 5 is a perspective view of the cleaning blade 62.

The cleaning blade 62 has a structure of a holder 621 having a reed-like shape formed of a rigid material such as metal or rigid plastic and an elastic blade 622 having a reed-like shape.

The front edge portion 62*c* of the elastic blade 622 has a mixed layer 62*d* of substrate and an acrylic resin and/or a methacrylic resin formed by the impregnation described later in detail.

In addition, a surface layer 623 (surface layer B) of an acrylic resin and/or a methacrylic resin is formed on a blade bottom surface 62*b* and a blade front edge surface 62*a* containing the front edge portion 63*c* of the elastic blade 622 in the longitudinal direction of the blade.

The elastic blade 622 is fixed onto one end of the holder 621 with an adhesive and the other end thereof is supported by the case of a cleaning device 6.

The elastic blade 622 is preferably formed of a material having a high impact resilience rate to track eccentricity of the image bearing member 3 and minute waviness on the surface of the image bearing member 3.

Specific examples thereof include, but are not limited to, typical synthetic rubber materials such as acrylic rubber, nitrile rubber, urethane rubber, ethylene propylene rubber, chlorosulfonated polyethylene, epichlorohydrin rubber, chloroplene rubber, silicone rubber, styrene-butadien rubber, butadiene rubber, and fluorine rubber.

Among these, urethane rubber containing a urethane group is preferable.

The mixed layer 62*d* of substrate and an acrylic resin and/or a methacrylic resin is formed by impregnating the elastic blade 622 with an acrylic and/or methacrylic monomer by a brushing method, a spraying method, a dip coating method, etc., to conduct cross-linking reaction.

The surface layer 623 of an acrylic and/or methacrylic resin is formed by coating the front edge portion 62*c* of the cleaning blade 62 with an acrylic and/or methacrylic monomer by a spray coating, a dip coating, a screen printing, etc. followed by cross-linking.

The cross-linking reaction of the acrylic and/or methacrylic monomer is conducted by providing energy such as heat, light, electron beams.

Specific examples of the acrylic and methacrylic monomers mentioned for use in the present disclosure include, but are not limited to, trimethylol propane triacrylate (TMPTA), trimethylol propane trimethacrylate, HPA modified trimethylol propane triacrylate, EO modified trimethylol propane triacrylate, PO modified trimethylol propane triacrylate, caprolactone modified trimethylol propane triacrylate, HPA modified trimethylol propane triacrylate, pentaerythritol triacrylate, pentaerythritol tetra acrylate (PETTA), glycerol triacrylate, ECH modified glycerol triacrylate, EO modified glycerol triacrylate, PO modified glycerol triacrylate, tris (acryloxyrthyl) isocyanulate, dipenta erythritol hexacrylate (DPHA), caprolactone modified dipenta erythritol hexacrylate, dipenta erythritol hydroxyl dipenta acrylate, alkylized dipenta erythritol tetracrylate, alkylized dipenta erythritol triacrylate, dimethylol propane tetracrylate (DTMPTA), penta erythritol ethoxy tetracrylate, EO modified phosphoric acid triacrylate, and 2,2,5,5-tetrahydroxy methyl cyclopentanone tetracrylate.

These can be used alone or in combination.

After impregnating the elastic blade 622 with liquid of acrylic and/or methacrylic resin for a predetermined period of time followed by air-drying, the front edge portion 62*c* of the cleaning blade 62 is coated by a spray-coating, a dip coating, a screen printing, etc. In the impregnation process of the liquid of acrylic and/or methacrylic cross-linkable resin, the mixed layer 62*d* of substrate and an acrylic resin and/or a methacrylic resin is formed.

In the application thereafter, the surface layer 623 of acrylic and/or methacrylic resin can be formed. The heat or light energy to cure the cross-linkable resin can be provided after the impregnation of the liquid of acrylic and/or methacrylic cross-linkable resin or after the application of the surface layer 623 of acrylic and/or methacrylic resin.

This cleaning blade 62 reduces deformation of the front edge portion 62*c* of the elastic blade 622 in the surface moving direction of the image bearing member 3 by the surface layer 623 of acrylic and/or methacrylic resin that contacts the image bearing member 3.

Furthermore, when the inside of the surface layer 623 of acrylic and/or methacrylic resin is abraded and exposed over time, the cleaning blade 62 is not deformed by the mixed layer 62*d* of substrate and an acrylic resin and/or a methacrylic resin formed by the impregnation thereof into the inside.

The thickness of the mixed layer 62*d* of the substrate and acrylic and/or methacrylic resin formed by impregnation with the liquid of acrylic and/or methacrylic cross-linkable resin for a predetermined time can be controlled by the kinds of acrylic and/or methacrylic monomers, the kinds of the solvent, the concentration of the solid portion, the impregnation time, the temperature, etc.

The thickness of the mixed layer 62*d* of the substrate and acrylic and/or methacrylic resin is from 5 μm to 100 μm and more preferably from 10 μm to 30 μm.

When the thickness of the mixed layer 62*d* of the substrate and acrylic and/or methacrylic resin is too thin, it is difficult to demonstrate such a suitable deformation prevention feature of the front edge portion 62*c* of the cleaning blade 62.

When the thickness of the mixed layer 62*d* of the substrate and acrylic and/or methacrylic resin is too thick, the hardness of the cleaning blade 62 tends to rise, which increases the burden on the image bearing member 3, resulting in an increase of the abrasion and occurrence of abnormal noises in a low temperature environment.

Furthermore, minute cracking tend to occur to the cleaning blade.

The mixed layer 62*d* of substrate and an acrylic resin and/or a methacrylic resin can be also formed when applying the surface layer 623 of acrylic and/or methacrylic resin.

In this case, the thickness is below the measurable range in most cases.

When the mixed layer 62*d* of substrate and an acrylic resin and/or a methacrylic resin is too thin, for example, less than 1 μm, the feature of the present disclosure is not easily exhibited.

The method of measuring the thickness of the mixed layer 62*d* of the substrate and acrylic and/or methacrylic resin can be obtained by the method using a micro IR described in JP-2011-138110-A.

The surface layer 623 of acrylic and/or methacrylic resin can be formed while the cleaning blade is impregnated with the liquid of acrylic and/or methacrylic cross-linkable resin for a predetermined period of time but the thus-formed layer of acrylic and/or methacrylic resin may be thin.

Therefore, it is preferable to conduct application of the liquid of acrylic and/or methacrylic cross-linkable resin after impregnating the cleaning blade therewith for a predetermined period of time and forming the mixed layer 62*d* of the substrate and acrylic and/or methacrylic resin.

The material of the surface layer 623 of acrylic and/or methacrylic resin is formed by applying the same acrylic and/or methacrylic monomers as the impregnating material described above followed by providing energy such as heat, light, and electron beams.

The surface layer 623 of acrylic and/or methacrylic resin preferably has a thickness of from 0.5 μm to 1.0 μm.

When the surface layer 623 of acrylic and/or methacrylic resin is too thin, it is difficult to demonstrate such a suitable deformation prevention feature of the front edge portion 62*c* of the cleaning blade 623.

When the surface layer 623 of acrylic and/or methacrylic resin is too thick, problems such as the turning inward or outward of the front edge portion 62*c* of the blade and cracking tend to occur while using the blade for an extended period of time Although a thin film of the surface layer 623 of acrylic and/or methacrylic resin is also formed while forming the mixed layer of acrylic and/or methacrylic resin, the feature of the present disclosure is not easily exhibited when the thickness is too thin, for example, less than 0.1 μm.

The thickness of the surface layer 623 of acrylic and/or methacrylic resin is measured by severing a cross section thereof and observing images taken by a scanning electron microscope or transmission electron microscope.

The front edge portion 62*c* of the cleaning blade 62 of the present disclosure has a laminate structure formed by impregnating the substrate of the elastic blade 622 with the acrylic and/or methacrylic resin to form the mixed layer 62*d* of the substrate and acrylic and/or methacrylic resin and the surface layer 623 of acrylic and/or methacrylic resin thereon which is harder than the elastic blade 622.

Thereby, the front edge portion 62*c* has a deformation prevention feature to the surface of the image bearing member 3 over an extended period of time.

A structure having only the surface layer 623 harder than the substrate of the elastic blade 622 without impregnation with acrylic and/or methacrylic resins is described below. Even if the surface layer 623 is provided, the surface layer 623 is abraded and disappears over time.

If the surface layer 623 is thickened to endure a long-time usage, the elastic deformation of the front edge portion 62*c* of the elastic blade 622 is inhibited, resulting in poor cleaning performance.

On the other hand, If the surface layer 623 is thinned to prevent inhibition of the elastic deformation of the front edge portion 62*c* of the elastic blade 622, the surface layer 623 is abraded to a degree that the substrate is exposed in a short time.

If the substrate, which has a low hardness, exposes and is brought into direct contact with the surface of the image bearing member 3, the friction factor between the cleaning blade 62 and the surface of the image bearing member 3 increases, resulting in occurrence of abnormal abrasion and abnormal noises.

The cleaning blade 62 of the present disclosure has the mixed layer 62*d* of the substrate and acrylic and/or methacrylic resin of the elastic blade 622 inside the surface layer 623 of acrylic and/or methacrylic resins having a high hardness.

As a result, the mechanical strength and the rigidity of the elastic rubber (urethane rubber) that forms the substrate are moderately strengthened, so that, in the slidable movement against the surface of the image bearing member 3, the behavior of the front end portion of the blade is moderately suppressed, which leads to good cleaning performance.

In addition, by reducing abnormal abrasion and abnormal noises, high abrasion resistance is exhibited.

Also, by providing only a hard surface layer to the substrate of the elastic blade 622, the hardness changes significantly at the boundary between the surface layer and the substrate layer, where the stresses intensify.

As a result, the elastic blade 622 may break. In the present disclosure, the mixed layer 62*d* of the substrate and acrylic and/or methacrylic resin is formed by impregnating the substrate of the elastic blade 622 with acrylic and/or methacrylic resins.

As a result, the hardness does not change abruptly at the boundary between the surface layer and the substrate, thereby preventing the breakage of the elastic blade 622 ascribable to intensified stress.

Furthermore, the acrylic resin and/or the methacrylic resin for use in the surface layer are more excellent about the durability than typically used resins for the surface layer.

Also, since both the surface layer and the mixed layer contain an acrylic resin and/or a methacrylic resin, the acrylic resin and/or the methacrylic resin in the mixed layer demonstrates so-called anchor effect to the acrylic resin and/or the methacrylic resin in the surface layer to increase the adhesion between the surface layer and the elastic blade.

This is inferred to contribute to further improvement of the durability of the surface layer. In addition, the acrylic resin and/or the methacrylic resin to form the mixed layer conduct cross-linking reaction without chemically bonding with the elastic blade 622 in comparison with typically-used isocyanate compound.

As a result, the cross-linking density of the mixed layer excessively increases, which removes the concern about the decrease of the elasticity of the elastic blade 622.

Furthermore, the image forming apparatus of the present disclosure reduces the occurrence of filming on the image bearing member, which is a phenomenon in which silica particles that are detached from toner are attached to and fixated on the surface of the image bearing member 3 due to the pressure by the cleaning blade 62.

While the hard layers of the image bearing member and the surface of the cleaning blade contact each other for a long time with friction, the friction between the image bearing member and the blade increases, which promotes fixation of the silica particles.

In addition, the image bearing member 3 is not easily abraded, which contributes to the filming on the image bearing member.

In particular, in a high temperature and a high humid environment, silica particles detached from toner tend to agglomerate, which significantly causes the filming on the image bearing member.

The mechanism of the image forming apparatus of the present disclosure capable of reducing the occurrence of the filming on the image bearing member by a combination of the image bearing member 3 having the structure described above and the cleaning blade 62 having the structure described above is inferred as follows.

Because of the fillers of metal oxides in the surface protection layer 38 of the image bearing member 3, the image bearing member 3 has a surface with extremely micro roughness, which makes fine nipping portions between the image bearing member 3 and the cleaning blade 62.

It makes it possible to prevent occurrence of large friction between the surface layer 623 having a high hardness of the cleaning blade 62 and the surface protection layer 38 of the image bearing member 3.

Furthermore, the front edge portion of the cleaning blade 62 has a laminate structure of the substrate, the mixed layer 62*d* of the substrate and acrylic and/or methacrylic resin, and the surface layer 623 of acrylic and/or methacrylic resins.

Since the front edge portion 62*c* of the cleaning blade 62 maintains stable behavior free from shaking caused by the surface moving of the image bearing member 3 because of this structure, the friction is not considered to increase.

As a result, abrasion between the surface protection layer 38 of the image bearing member 3 and the front edge portion 62*c* of the cleaning blade 62 can be reduced.

In addition, the friction heat is less generated, which is advantageous in terms of the filming on image bearing member filming.

The image forming apparatus of the present disclosure is described.

The entire structure of the image forming apparatus is described first.

The image forming apparatus of the present disclosure includes the image bearing member 3, a charger, an irradiator, a development device, a transfer device, a cleaner, and a fixing device with optional devices such as a discharging device, a recycling device, and a control device.

A combination of the charger and the irradiator is also referred to as a latent electrostatic image forming device.

Figure 3:
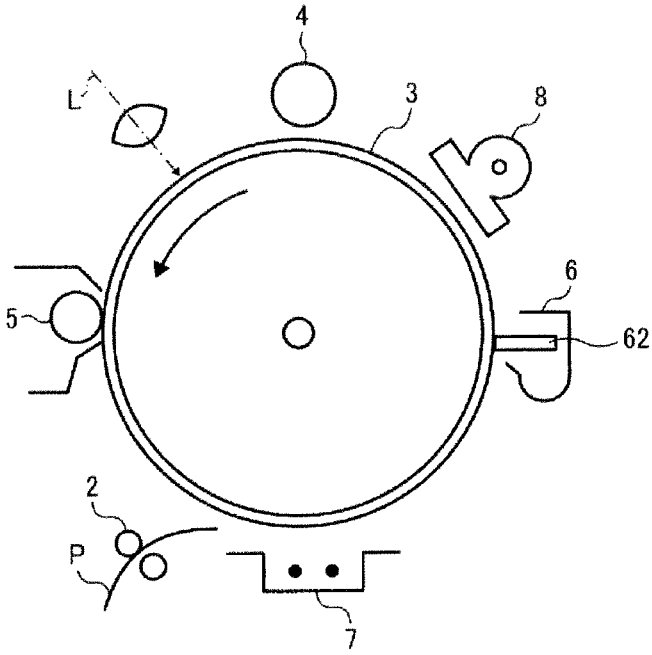
FIG. 3 is a schematic diagram illustrating an example of the image forming apparatus of the present disclosure.

FIG. 3 is a schematic diagram illustrating an example of the image forming apparatus of the present disclosure.

In the image forming apparatus of FIG. 3, there are provided a charger 4, an irradiator L. a development device 5, a transfer device 7, a cleaner 6, and a discharging device 8 around the image bearing member 3.

The charger 4 charges the image bearing member 3.

A specific example thereof is a charging roller.

Other specific examples thereof include, but are not limited to, a corotron device, a scorotron device, a solid discharging element, a needle electrode device, a roller charger, and an electroconductive brush device.

The irradiator L forms a latent electrostatic image on the charged image bearing member 3.

A fluorescent lamp, a tungsten lamp, a halogen lamp, a mercury lamp, a sodium lamp, a light emitting diode (LED), a semiconductor laser (LD), electroluminescence (EL), etc. can be used as the light source of the irradiator L.

Various kinds of optical filters, for example, a sharp cut filter, a band-pass filter, a near infrared filter, a dichroic filter, a coherent filter, and a color conversion filter, can be used to irradiate the image bearing member 3 with light having only a particular wavelength range.

The development device 5 visualizes the latent electrostatic image formed on the image bearing member 3.

As the development method, there are a one-component development method and a two-component development method using a dry toner.

When the image bearing member 3 is positively (or negatively) charged and irradiated, a positive (or negative) latent electrostatic image is formed on the surface of the image bearing member 3.

When the latent electrostatic image is developed with a negatively (or positively) charged toner (volt-detecting fine particles), a positive image is formed.

When the latent electrostatic image is developed using a positively (or negatively) charged toner, a negative image is formed.

A transfer device 7 transfers the toner image visualized on the image bearing member 3 to a recording medium 15.

A specific example thereof is a transfer charger. A pre-transfer charger can be used to improve the transferring performance.

The transfer device can employ an electrostatic transfer system using a transfer charger or a bias roller, a mechanical transfer system using an adhesive transfer method, a pressure transfer method, etc., and a magnetic transfer system.

The charger described above can be used as the electrostatic transfer system.

A separation charger or a separation claw is used to separate the recording medium P from the image bearing member 3.

Other separation devices that employ, for example, electrostatic sucking induction separation, side edge belt separation, front edge grip conveyance, and curvature separation can be used.

The charger described above can be used as the separation charger.

As the cleaner 6, the cleaning blade 62 having the structure described above is used to remove toner remaining on the image bearing member 3 after transfer.

A pre-cleaning charger can be used for more efficient cleaning performance.

A discharging device can be optionally used to remove the latent electrostatic image on the image bearing member 3.

As the discharging unit, a discharging lamp 8 or a discharging charger can be used.

The irradiation light source and the charger described above can be used.

In FIG. 3, the reference numeral 2 represents a registration roller.

In addition, with regard to the processes that are conducted not in the vicinity of the image bearing member 3, i.e., reading an original, sheet-feeding, fixing, and paper-discharging, known devices and methods in the art can be used.

Specific examples of the image forming apparatus include, but are not limited to, a photocopier, a facsimile machine, a printer, and a direct digital printmaker.

Furthermore, in the image forming apparatus of the present disclosure, at least the image bearing member 3 and the cleaner 6 are integrally united and form a process cartridge 1 detachably attachable to the image forming apparatus.

Figure 4:
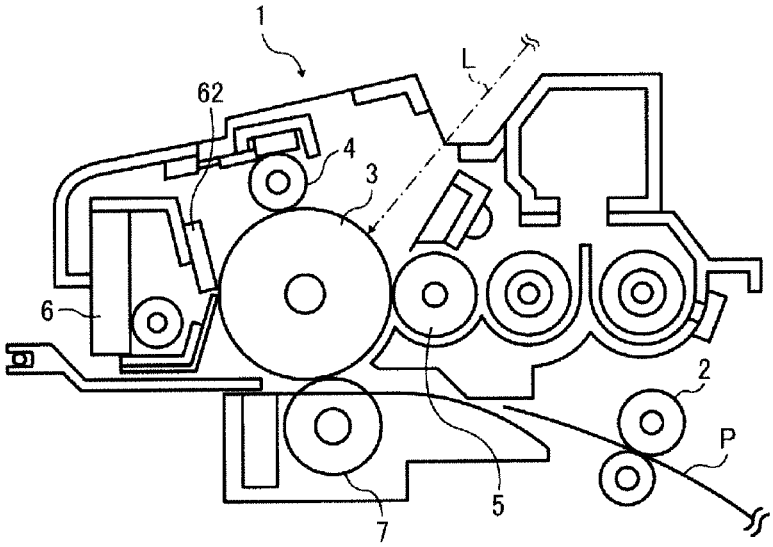
FIG. 4 is a schematic diagram illustrating an example of the process cartridge of the present disclosure.

FIG. 4 is a schematic diagram illustrating an example of the process cartridge 1 of the present disclosure.

The process cartridge of FIG. 4 includes the image bearing member 3, the charger 4, the development agent 5, the cleaning blade 62 as the cleaner 6, and other optional devices.

The image forming processes conducted in the image forming apparatus and each device are described in detail.

Charging Process and Charger

The charging process is conducted by the charger to charge the surface of the image bearing member 3.

The charging process is performed by, for example, applying a voltage to the surface of the image bearing member 3 with the charger.

There is no specific limit to the charger and any known charger can be selected.

A known contact type charger having an electroconductive or semi-electroconductive roll, brush, film, rubber blade, etc. and a non-contact type charger such as a corotron or a scorotron which uses corona discharging can be used.

The charger may employ any form other than the roller, for example, a magnetic brush, and a fur brush and can be selected according to the specification or form of an image forming apparatus.

When a magnetic brush is used, the magnet brush uses a charging member formed of, for example, ferrite particles such as Zn—Cu ferrite.

The magnetic brush is held on a non-magnetic electroconductive sleeve, and a magnet roller is provided inside the non-magnetic electroconductive sleeve.

When a brush is used, fur electroconductively-treated by carbon, copper sulfide, metal or metal oxide is used as a fur brush material and rolled on or attached to metal or electroconductively treated metal core to make the charger.

The charger is not limited to the contact type charger described above, but using such a contact type charger is preferable to manufacture an image forming apparatus that produces a less amount of ozone.

It is preferable to apply a direct voltage or a voltage obtained by superimposing an alternating voltage to a direct voltage to the surface of the image bearing member 3 by the charger arranged in contact with or in the vicinity of the image bearing member 3.

It is preferable to apply a direct voltage or a voltage obtained by superimposing an alternating voltage to a direct voltage to the surface of the image bearing member 3 by a charging roller arranged in the vicinity (non-contact) of the image bearing member 3 via a gap tape.

Irradiation Process and Irradiator

The irradiation process is conducted by the irraditor to irradiate the surface of the charged image bearing member 3.

Irradiation is performed by, for example, irradiating the surface of the image bearing member 3 with the irradiator based on obtained image data.

The optical system in the irradiation is classified into an analog optical system and a digital optical system.

The analog optical system projects an original manual directly on the image bearing member 3 and the digital optical system receives image data as electric signals, converts the electric signals into optical signals, and irradiates the image bearing member 3 to form images.

There is no specific limit to any irradiator capable of irradiating the surface of the image bearing member 3 charged by the charger with light based on obtained image data.

Specific examples thereof include, but are not limited to, any known irradiators such as a photocopying optical system, a rod lens array system, a laser optical system, a liquid crystal shutter optical system, and an LED optical system.

As to the present disclosure, the rear side irradiation system can be employed in which the image bearing member 3 is irradiated from the rear side.

Development Process and Development Device

The development process is conducted by the development device to develop the latent electrostatic image with toner or developing agent to form a visual image.

The visual image is formed by, for example, developing the latent electrostatic image with toner or a development agent by the development device.

There is no specific limit to the development device as long as the development device develops a latent electrostatic image with the toner or the development agent and any known development device can be used.

For example, a development device containing a development container which accommodates and applies the toner or the development agent to the latent electrostatic image in a contact or non-contact manner is suitably used.

The development device is either of a dry development type, a wet development type, a single color development type, or a multi-color development type.

The development device suitably includes, for example, a stirrer that triboelectrically charges the toner or the development agent and a rotatable magnet roller.

In the development unit, for example, toner and carrier are mixed and stirred to frictionally charge the toner.

The charged toner is held and stands on the surface of the magnet roller in rotation like a filament to form a magnet brush. Since the magnet roller is provided in the vicinity of the image bearing member 3, part of the toner forming the magnet brush borne on the surface of the magnet roller is transferred to the surface of the image bearing member 3 by electric attraction force.

As a result, the latent electrostatic image is developed with the toner to form a visual toner image on the surface of the image bearing member 3.

The development agent accommodated in the development device contains the toner and can be a single component development agent or a two component development agent.

Transfer Process and Transfer Device

The transfer process is conducted by the transfer device to transfer, for example, the visual image to the recording medium P.

Specific examples of the transfer device include, but are not limited to, a corona transfer device using corona discharging, a transfer belt, a transfer roller, a pressure transfer roller, and an adhesive transfer device.

A typical example of the recording medium P is plain paper but any paper to which a non-fixed image after development is transferred can be suitably used.

PET base for an overhead projector can be also used.

Fixing Process and Fixing Device

The fixing process fixes the visual image transferred to the recording medium P.

Fixing can be conducted every time each color toner image is transferred to the recording medium or at once for a multicolor layered image.

Any fixing device can be suitably selected.

Any known heating and pressure device can be used.

A combination of a heating roller and a pressure roller and a combination of a heating roller, a pressure roller, and an endless belt can be used as the heating and pressure device. The pressure and heating roller is preferably heated to a temperature range of from 80° C. to 200° C.

In addition, in the present invention, any known optical fixing device can be used together with or instead of the fixing device in the fixing process mentioned above.

Discharging Process and Discharging Device

The discharging process is suitably performed by a discharging device to apply a discharging bias to the image bearing member 3 to discharge the image bearing member 3.

There is no specific limit to the discharging device and any known discharging device.

For example, a discharging lamp can be suitably selected as long as it can apply a discharging bias to the image bearing member 3.

Other Processes

The recycling process returns the toner removed in the cleaning process to the development device for reuse and is conducted by a recycling device.

Any known recycling device can be suitably selected and used.

The control process can be suitably performed by a control device to control each process described above.

There is no specific limit to the control device as long as the device can control the behavior of each device. Any control device can be suitably selected and used.

For example, devices such as a sequencer and a computer can be used.

The toner for suitably use in the image forming apparatus of the present disclosure is described.

Such toner can be used as mother toner particles.

In the mixing, kneading, and pulverization method, the mother toner, a resin, a pigment, a charge control agent, and a releasing agent are mixed and kneaded followed by cooling down, pulverization, classification.

To obtain toner having a uniform particle size and form, it is preferable to use a polymerized toner manufacturing method such as an emulsification polymerization method and a solution suspension method.

To be specific, the materials for toner obtained by a polyester poymerization method are described.

Polyester Resin

The polyester resin is obtained by polycondensation reaction of a polyol and a polycarboxylic compound.

Suitable polyols (PO) include, for example, diols (DIO) and polyols (TO) having three or more hydroxyl groups.

Among these, a simple diol (DIO) or a mixture in which a small amount of a polyol (TO) is mixed with a diol (DIO) is preferable.

Specific examples of the diols (DIO) include, but are not limited to, alkylene glycol (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F and bisphenol S); adducts of the alicyclic diols mentioned above with an alkylene oxide (e.g., ethylene oxide, propylene oxide and butylene oxide); and adducts of the bisphenols mentioned above with an alkylene oxide (e.g., ethylene oxide, propylene oxide and butylene oxide); etc.

Among these compounds, alkylene glycols having 2 to 12 carbon atoms and adducts of a bisphenol with an alkylene oxide are preferable.

Adducts of bisphenol with an alkylene oxide and mixtures of an adduct of a bisphenol with an alkylene oxide and an alkylene glycol having 2 to 12 carbon atoms are particularly preferable.

Specific examples of the polyols (TO) having three or more hydroxyl groups include, but are not limited to, glycerin, trimethylol ethane, trimethylol propane, pentaerythritol and sorbitol); polyphenols having three or more hydroxyl groups (trisphenol PA, phenol novolak and cresol novolak); and adducts of the polyphenols having three or more hydroxyl groups mentioned above with an alkylene oxide.

Specific examples of polycarboxylic acids (PC) include, but are not limited to, dicarboxylic acids (DIC) and polycarboxylic acids (TC) having three or more hydroxyl groups.

Among these, a simple dicarboxylic acid (DIC) or a mixture in which a small amount of a polycarboxylic acid (TC) is mixed with a dicarboxylic acid (DIO) is preferable.

Specific examples of the dicarboxylic acids (DIC) include, but are not limited to, alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having 4 to 20 carbon atoms and aromatic dicarboxylic acids having 8 to 20 carbon atoms are preferably used.

Specific examples of the polycarboxylic acids (TC) having three or more hydroxyl groups include, but are not limited to, aromatic polycarboxylic acids having from 9 to 20 carbon atoms (e.g., trimellitic acid and pyromellitic acid).

As the polycarboxylic acid (PC), anhydrides or lower alkyl esters (e.g., methyl esters, ethyl esters or isopropyl esters) of the polycarboxylic acids mentioned above can be used for the reaction with a polyol (PO).

A suitable mixing ratio (i.e., an equivalence ratio [OH]/[COOH]) of a polyol (PO) to a polycarboxylic acid (PC) is from 2/1 to 1/1, preferably from 1.5/1 to 1/1, and more preferably from 1.3/1 to 1.02/1.

Heat the polyol (PO) and the polycarboxylic acid (PC) to 150° to 280° C.° under the presence of known esterification catalysts such as tetrabuthoxy titanate, dibutyl tin oxide, etc. for polycondensation reaction; distill away produced water with a reduced pressure, if necessary, to obtain a polyester having a hydroxyl group.

The hydroxyl value of the polyester resin is preferably 5 mgKOH/g or higher and the acid value thereof is preferably from 1 mgKOH/g to 30 mgKOH/g, and further preferably from 5 mgKOH/g to 25 mgKOH/g. Polyester resins having an acid value tend to be negatively charged and contribute to improve the affinity between the recording medium and the toner when fixing the image on the recording medium, thereby ameliorating the low temperature fixing property.

However, when the acid value is too large, the stability of the chargeability tends to deteriorate, in particular in the change in the environment.

The weight average molecular weight of the polyester is preferably from 10,000 to 400,000 and more preferably from 20,000 to 200,000.

When the weight average molecular weight is too small, the hot offset resistance tends to deteriorate.

When the weight average molecular weight is too large, the low temperature fixing property tends to deteriorate.

It is preferable that the polyester resin contains a urea-modified polyester resin in addition to non-modified polyester resin obtained in the polycondensation reaction described above.

The urea-modified polyester resin is obtained by reacting a carboxyl group or a hydroxyl group present at the end of the polyester resin obtained by the polycondensation reaction with a polyisocyanate compound (PIC) to obtain a polyester prepolymer A having an isocyante group followed by cross-linking and/or elongation of the molecular chains thereof caused by reaction with an amine.

Specific examples of the polyisocyanates (PIC) include, but are not limited to, aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic diisosycantes (e.g., tolylene diisocyanate and diphenylmethane diisocyanate); aromatic aliphatic diisocyanates (e.g., α,α,α',α'-tetramethyl xylylene diisocyanate); isocyanates; blocked polyisocyanates in which the polyisocyanates mentioned above are blocked with phenol derivatives thereof, oximes or caprolactams; etc.

These compounds can be used alone or in combination.

Suitable ratio (i.e., [NCO]/[OH]) of a polyisocyanate (PIC) to a polyester having a hydroxyl group (OH) is from 5/1 to 1/1, preferably from 4/1 to 1.2/1, and more preferably from 2.5/1 to 1.5/1.

When the [NCO]/[OH] ratio is too large, the low temperature fixability of the toner tends to deteriorate.

When the molar ratio of [NCO] is too small, the urea content of the ester tends to decrease when the urea-modified polyester is used, which leads to deterioration of the hot offset resistance.

The content of the constitutional component of a polyisocyanate (PIC) in the polyester prepolymer A having an isocyanate group is from 0.5% by weight to 40% by weight, preferably from 1% by weight to 30% by weight, and more preferably from 2% by weight to 20% by weight.

A content that is too low easily degrades the hot offset resistance of the toner and disadvantageous in terms of having a good combination of high temperature storage and low temperature fixing property.

In contrast, when the content is too high, the low temperature fixing property tends to deteriorate.

The number of isocyanate groups included in the prepolymer (A) per molecule is preferably not less than 1, more preferably from 1.5 to 3, and furthermore preferably from 1.8 to 2.5.

When the number of isocyanate groups is too small, the molecular weight of urea-modified polyester tends to be small, thereby easily degrading the hot offset resistance.

Specific examples of the amines B to react the polyester prepolymer A include, but are not limited to, diamines (B1), tri- or higher amines (B2), amino alcohols (B3), amino mercaptans (B4), amino acids (B5), and blocked amines (B6) in which the amino groups of the amines (B1-B5) mentioned above are blocked.

Specific examples of the diamines (B1) include, but are not limited to, aromatic diamines (e.g., phenylene diamine, diethyltoluene diamine, and 4,4 f-diaminodiphenyl methane); alicyclic diamines (e.g., 4,4 f-diamino-3,3 f-dimethyldicyclohexyl methane, diaminocyclohexane and isophoron diamine); aliphatic diamines (e.g., ethylene diamine, tetramethylene diamine, and hexamethylene diamine); etc. Specific examples of the tri- or higher polyamines (B2) include, but are not limited to, diethylene triamine and triethylene tetramine.

Specific examples of the amino alcohols (B3) include, but are not limited to, ethanol amine and hydroxyethyl aniline. Specific examples of the amino mercaptan (B4) include, but are not limited to, aminoethyl mercaptan and aminopropyl mercaptan.

Specific examples of the amino acids (B5) include, but are not limited to, amino propionic acid and amino caproic acid. Specific examples of the blocked amines (B6) include, but are not limited to, ketimine compounds which are prepared by reacting one of the amines B1-B5 mentioned above with a ketone such as acetone, methyl ethyl ketone and methyl isobutyl ketone; oxazoline compounds, etc. Among these, (B1) and a mixture of (B1) with a small amount of (B2) are preferred.

The mixing ratio of the isocyanate group to the amines (B), i.e., the equivalent ratio ([NCO]/[NHx]) of the isocyanate group [NCO] contained in the prepolymer A to the amino group [NHx] contained in the amines B, is normally from 1/2 to 2/1, preferably from 1.5/1 to 1/1.5, and more preferably from 1.2/1 to 1/1.2.

When the mixing ratio is too large or too small, the molecular weight of the resultant urea-modified polyester decreases, resulting in deterioration of the hot offset resistance of the resultant toner.

In addition, the urea-modified polyester may contain a urethane bond in addition to the urea bond. The molar ratio of the content of the urea bond to the content of the urethane bonding is from 100/0 to 10/90, preferably from 80/20 to 20/80 and more preferably from 60/40 to 30/70.

When the molar ratio of the urea bond is too small, the anti-hot offset property tends to deteriorate.

This urea-modified polyester is manufactured by, for example, the following one-shot method.

Heat the polyol (PO) and the polycarboxylic acid (PC) to 150° C. to 280° C. under the presence of known esterification catalysts such as tetrabuthoxy titanate, dibutyl tin oxide, etc. for polycondensation reaction; distill away produced water with a reduced pressure, if necessary, to obtain a polyester having a hydroxyl group; React the polyester with the polyisocyuate (3) at 40° C. to 140° C. to obtain the polyester prepolymer A having an isocyanate group; and furthermore, conduct reaction between the prepolymer A and the amine B at 0° C. to 140° to obtain a urea-modified polyester.

During the reaction of the polyisocyanate (PIC) and the prepolymer (A) and the amine (B), an optional solvent can be used.

Examples of such solvents are inert compounds to the isocyanate (PIC) and specific examples thereof include, but are not limited to, aromatic solvents (toluene, xylene); ketones (acetone, methylethyl ketone, methylisobutyl ketone); esters (ethyl acetate); amides (dimethylformamide, dimethylacetamide); and ethers (tetrahydrofuran).

Furthermore, the molecular weight of the urea-modified polyesters can be adjusted by using a molecular weight control agent for the cross-linking reaction and/or elongation reaction between the polyester prepolymer A and the amine B.

Specific preferred examples of the molecular weight control agent include, but are not limited to, monoamines (e.g., diethyl amine, dibutyl amine, butyl amine and lauryl amine) having no active hydrogen group, and blocked amines (i.e., ketimine compounds) prepared by blocking the monoamines mentioned above.

The weight average molecular weight of the urea-modified polyester is preferably 10,000 or higher, more preferably from 20,000 to 10,000,000 and further preferably from 30,000 to 1,000,000.

When the weight average molecular weight is too small, the hot offset resistance tends to deteriorate.

The number average molecular weight of the urea-modified polyester is not particularly limited when the unmodified polyester mentioned above is used.

The number average molecular weight is controlled to obtain the weight average molecular weight within the range specified above.

When the polyester is singly used, the number average molecular weight is preferably from 2,000 to 15,000, more preferably from 2,000 to 10,000, and furthermore preferably from 2,000 to 8,000.

When the number average molecular weight is too large, the low temperature fixability of the resultant toner tends to deteriorate, and in addition the gloss of full color images worsens when the toner is used in a full color image forming apparatus.

This combinational use of the non-modified polyester resin and the urea-modified polyester resin is preferable to a single use of the urea-modified polyester resin in terms of improvement of the low temperature fixability of the toner and the gloss property when the toner is used in a full-color image forming apparatus.

The non-modified polyester resin may contain a polyester modified by a chemical bond other than urea bond.

It is preferable that the non-modified polyester resin and urea-modified polyester resin are at least partially compatible in each other in terms of the low temperature fixing property and the hot offset resistance.

Therefore, the non-modified polyester resin and the urea-modified polyester resin preferably have similar compositions.

The weight ratio of the non-modified polyester resin to the urea-modified polyester is from 20/80 to 95/5, preferably from 70/30 to 95/5, more preferably from 75/25 to 95/5, and particularly preferably from 80/20 to 93/7.

A ratio of the urea-modified polyester resin that is too small, for example, less than 5%, tends to degrade the hot offset resistance and also be disadvantageous to strike a balance between the high temperature preservability (stability) and the low temperature fixing property.

The glass transition temperature (Tg) of the binder resin containing the non-modified polyester resin and the urea-modified polyester resin is preferably from 45° C. to 65° C. and more preferably from 45° C. to 60° C.

When the glass transition temperature is too low, the high temperature preservability of the toner may deteriorate.

When the glass transition temperature is too high, the low temperature fixing property may deteriorate.

The toner tends to have a relatively good high temperature stability even when the low glass transition temperature is low in comparison with a known polyester based toner because the urea-modified polyester resins tend to be present on the surface of the obtained mother toner particle.

Coloring Agent

There is no specific limit to the coloring agent and suitable coloring agents include known dyes and pigments.

Specific examples thereof include, but are not limited to, carbon black, Nigrosine dyes, black iron oxide, Naphthol Yellow S, Hansa Yellow (10G, 5G and G), Cadmium Yellow, yellow iron oxide, loess, chrome yellow. Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Faise Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G. Lithol Rubine GX, Permanent Red F5R, Brilliant Carmine 6B, Pigment Scarlet 3B, Bordeaux 5B, Toluidine Maroon, Permanent Bordeaux F2K, Hello Bordeaux BL, Bordeaux 10B, BON Maroon Light, BON Maroon Medium, Eosin Lake, Rhodamine Lake B, Rhodamine Lake Y, Alizarine Lake, Thioindigo Red B. Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone BlueFast Violet B. Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like.

These materials can be used alone or in combination.

The content of the coloring agent in the toner is preferably from 1% by weight to 15% by weight and more preferably from 3% by weight to 10% by weight.

The coloring agent and the resin can be used in combination as a master batch.

Specific examples of the binder resins for use in manufacturing of the master batch or for use in combination with master batch include, but are not limited to, styrene polymers and substituted styrene polymers such as polystyrene, poly-p-chlorostyrene, and polyvinyltoluene; copolymers of thereof with vinyl compounds, polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, polyacrylic resins, rosin, modified rosins, terpene resins, aliphatic or alicyclic hydrocarbon resins, aromatic petroleum resins, chlorinated paraffin, and paraffin waxes.

These can be used alone or in combination.

Charge Control Agent

There is no specific limit to the charge control agent.

Any known charge control agent can be used.

Specific examples of the charge control agents include, but are not limited to, nigrosine dyes, triphenylmethane dyes, chrome containing metal complex dyes, chelate pigments of molybdic acid, Rhodamine dyes, alkoxyamines, quaternary ammonium salts (including fluorine-modified quaternary ammonium salts, alkylamides, phosphor and compounds including phosphor, tungsten and compounds including tungsten, fluorine-containing activators, metal salts of salicylic acid, and metal salts of salicylic acid derivatives.

Specific examples of the marketed products of the charge controlling agents include, but are not limited to, BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, pesylene, quinacridone, azo pigments and polymers having a functional group such as a sulfonate group, a carboxyl group, a quaternary ammonium group, etc.

These materials can be used alone or in combination.

Among these, the materials that controls the toner to be negatively-charged are particularly preferable.

The content of the charge control agent is determined depending on the kind of the binder ream, whether or not an additive is optionally added, and the toner manufacturing method (including the dispersion method), and thus is not unambiguously defined.

However, the content of the charge control agent is preferably from 0.1 parts by weight to 0.2 parts by weight and more preferably from 0.2 parts by weight to 5 parts by weight, based on 100 parts by weight of the binder resin.

When the addition amount is too large, the toner tends to have an excessively large size of charge, which reduces the effect of the charge control agent.

Therefore, the electrostatic attraction force between a developing roller and the toner increases, resulting in deterioration of the fluidity of the toner and a decrease in the image density.

Releasing Agent

As the release agent a wax having a melting point of from 50° C. to 120° C. is suitable.

When such a wax is dispersed in the binder resin, the wax is more effectively serves as a release agent at the interface between a fixing roller and the toner.

Consequently, the hot offset resistance is improved without applying a releasing agent such as an oil to the fixing roller used.

Specific examples of such waxes include the following: Vegetable waxes such as carnauba wax, cotton wax, Japan wax, and rice wax; animal waxes such as bee wax aid lanolin; mineral waxes such as ozokelite and Cercine; and petroleum waxes such as paraffin, microcrystalline, and petrolatum; In addition to these natural waxes, synthesis hydrocarbon waxes such as Fischer-Tropsch wax, polyethylene wax and synthesis waxes such as esters, ketones and ethers; and Fatty acid amides such as 1,2-hydroxylstearic acid amide, stearic acid amide and phthalic anhydride imide; low molecular weight crystalline resins such as acrylic homopolymers or copolymers having a long alkyl group in their side chains such as poly-n-stearyl methacrylate and poly-n-lauryl methacrylate (e.g., such as n-stearyl acrylate-ethyl methacrylate copolymers).

The charge control agent and the release agent can be kneaded with the master batch and the binder resin.

In addition, the charge control agent and the release agent can be added when dissolved and dispersed in the organic solvent.

External Additive

After manufacturing the toner, the toner is mixed with external additives to attach the external additives to the surface of the toner, thereby improving the cleaning property of the toner.

At least, using hydrophobic silica particles as one of the external additives is desirable.

The hydrophobic silica particles are surface-treated to improve the hydrophobicity, thereby preventing deterioration of the fluidity characteristics and chargeability in a high humidity environment. Specific examples of the surface-treating agents include, but are not limited to, silane coupling agents, silylation agents, silane coupling agents including a fluoroalkyl group, organic titanate coupling agents, aluminum coupling agents, silicone oils, and modified silicone oils.

The primary particle average diameter of the hydrophobic silica particles is preferably from 10 nm to 200 nm.

When the primary particle average diameter is too small, the cleaning property of the toner tends to deteriorate, which causes production of defective images having streaks. When the primary particle average diameter is too large, the fluidity and the chargeability of the toner tend to worsen, resulting in occurrence of background fouling.

The primary particle average diameter of the hydrophobic silica particles can be obtained by measuring the diameter of arbitrarily-selected 50 particles in an observation image prepared by using an electron microscope such as a scanning electron microscope (SEM) and transmission electron microscope (TEM) followed by calculation of the average of the results.

The hydrophobicity of the hydrophobic silica particles is preferably from 50% to 90% and more preferably from 60% to 80%.

When the hydrophobicity is too low, the leakage of the charge of the toner tends to become large in a high temperature and moisture environment, which easily causes toner scattering and fogging on the image bearing member.

When the hydrophobicity is too large, the charging size of the toner tends to excessively increase in a low temperature and moisture environment, which results in the image density defects of the produced image.

In addition, extra hydrophobizing agent may have an adverse impact on the fluidity of the toner, etc.

The measuring method of the hydrophobicity is as follows:

Place 50 ml of water in a beaker; Add 0.2 g of hydrophobic silica particles thereto; Drop metahnol from the burette the top end of which is dipped in the water while slowly stirring the content in the beaker with a magnetic stirrer; Read the number of ml of the dropped methanol when the floating hydrophobic silica particles completely sink in the water and assign the number in the following relation to calculate the hydrophobicity.

Hydrophpbicity (%)=the number of ml of dropped methanol/(50+the number of ml of dropped methanol)×100

It is possible to use other external additives in combination with the hydrophobic silica particles.

Specific examples thereof include, but are not limited to, inorganic particulates such as silica, alumina, titania, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

The content of the external additive in the toner is preferably from 0.01% by weight to 5.0% by weight and more preferably from 0.01% by weight to 2.0% by weight.

Other Component

There is no specific limit to the other components.

Specific examples thereof include, but are not limited to, a fluidity improver, a cleaning property improver, a magnetic material, and metal soap.

In recent years, sphere-like small toner particles have been used to produce quality images.

However, in the embodiments of the present disclosure, considering removal of the toner remaining on the image bearing member, the hydrophobic silica particles are used as the external additive on the surface of the toner to improve the cleaning property and reduce attachment between the image bearing member and the toner or the intermediate transfer belt and the toner.

Furthermore, the fluidity and the chargeability are improved by weakening the attachment between the toner particles.

However, the silica particles which have once detached from the toner tend to adhere to the surface of the image bearing member.

Such attached silica particles gradually accumulate and furthermore attract toner resins, which results in large attached materials.

This attached material causes defective images.

In particular, with regard to the cleaning blade having a surface layer of the embodiment, the silica particles are strongly pressed against the image bearing member, which results in attachment of the silica particles to the image bearing member.

Therefore, in the embodiment of the present disclosure, the image bearing member 3 contains fillers made of a metal oxide and has the surface protection layer 38 having a surface hardness of 200 ($N/mm^2$) or higher, so that the surface becomes rough and hard.

Consequently, the occurrence of the filming on the image bearing member is reduced.

The cleaning blade 62 is formed of the reed-like elastic blade 622 and the laminar structure is formed of the mixed layer 62*d* of the substrate and acrylic and/or methacrylic resin made by impregnating the substrate of the elastic blade 622 with the acrylic and/or methacrylic resin and the surface layer 623 of acrylic and/or methacrylic resin on the mixed layer 62*d*, which is harder than the elastic blade 622.

Thereby, the front edge portion 62*c* has a deformation prevention feature to the surface of the image bearing member 3 over an extended period of time, thereby contributing to production of quality images free from defects.

Having generally described (preferred embodiments of) this invention, further understanding can be obtained by reference to certain specific examples which are provided herein for the purpose of illustration only and are not intended to be limiting.

In the descriptions in the following examples, the number represent weight ratios in parts, unless otherwise specified.

EXAMPLES

First, the image bearing member is described. The image bearing members 1 to 20 are manufactured in the following conditions.

Image Bearing Member 1

The liquid application of undercoating layer, the liquid application of charge generation layer, and the liquid application of charge transport layer, which have the following components are sequentially applied to an aluminum cylinder having a diameter of 40 mm as the electroconductive substrate 31 and dried to form the undercoating layer 34 having a thickness of about 3.5 μm, the charge generation layer 35 having a thickness of about 0.2 μm, and the charge transport layer 36 having a thickness of about 23 μm. Subsequent to drying check by finger touch for respective layers, the undercoating layer 34 is dried at 130° C., the charge generation layer 35 is dried at 95° C., and the charge transport layer 36 is dried at 120° C. for 20 minutes to obtain a laminate image bearing member having the undercoating layer 34, the charge generating layer 35, and the charge transport layer 36 on the electroconductive substrate 31.

Form the surface protection layer 38 on the laminate image bearing member by applying the liquid application 1 of the protection layer thereto and drying at 130° C. for 20 minutes to obtain an image bearing member 1 having the undercoating layer 34, the charge generation layer 35, the charge transport layer 36, and the surface protection layer 38 on the electroconductive substrate 31.

The surface protection layer 38 has a thickness of about 3.0 μm.

Liquid Application of Undercoating Layer

Titanium oxide (CR-EL, average particle diameter 0.25 μm, particle density: 4.3 $g/cm^3$, manufactured by ISHIHARA SANGYO KAISHA, LTD.): 50 parts Alkyd resin (Beckolite 6401-50, solid portion: 50%, manufactured by Dainippon Ink and Chemicals, Inc.): 14 parts Melamine resin (L-145-60, solid portion: 60%, manufactured by Dainippon Ink and Chemicals Inc.): 8 parts 2-butanone: 70 parts Liquid Application of Charge Generation Layer Place titanyl phthalocyanine crystal and 2-butanone solution where polyvinyl butyral is dissolved in a marketed bead mill dispersion device using PSZ balls having a diameter of 0.5 mm; Conduct dispersion for 30 minutes at 1,200 rpm to prepare a liquid application of charge generation layer Synthesis of Titanylphthalocyanine Crystal: 15 parts Polyvinylbutyral (BX-1, manufactured by Sekisui Chemical Co., Ltd.): 10 parts 2-butanone: 280 parts Liquid Application of Charge Transport Layer Bisphenol Z polycarbonate (PanLite TS-2050, manufactured by Teijin Chemicals Ltd.): 10 parts Charge transport material represented by the following Chemical Structure 1: 7 parts Chemical Structure 1

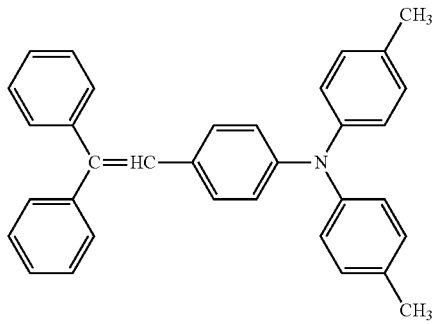

Tetrahydrofuran: 68 parts

Tetrahydrofuran solution of 1% by weight Silicone oil (KF-50-100 CS, manufactured by Shin-Etsu Chemical Co., Ltd.): 0.2 parts Liquid Application 1 of Protection Layer Resin: Bisphenol Z polycarbonate (PanLite TS-2050, resin density: 1.2 g/cm$^3$, manufactured by Teijin Chemicals Ltd.): 10 parts Metal oxide filler: Titanium oxide (CR-EL average particle diameter: 0.25 μm, particle density: 4.3 g/cm$^3$, manufactured by ISHIHARA SANGYO KAISHA, LTD.): 3.1 parts Solvent: Tetrahydrofuran: 118 parts Image Bearing Member 2

Manufacture a laminate image bearing member having the electroconductive substrate 31, the undercoating layer 34, the charge generation layer 35, and the charge transport layer 36 in the same manner as in the case of the image bearing member 1.

Apply the liquid application 2 of the protection layer to the laminate image bearing member and dry it at 130° C. for 20 minutes to obtain an image bearing member 2 having the undercoating layer 34, the charge generation layer 35, the charge transport layer 36, and the surface protection layer 38 on the electroconductive substrate 31.

Liquid Application 2 of Protection Layer

Resin: phenolic resin (PR-50404, solid portion ensity: 80%, resin density: 1.4 g/cm$^3$, manufactured by SUMITOMO BAKELITE CO., LTD.): 12.5 parts Metal oxide filler: Titanium oxide (CR-EL, average particle diameter 0.25 μm, particle density: 4.3 g/cm$^3$, manufactured by ISHIHARA SANGYO KAISHA, LTD): 2 parts Solvent: Tetrahydrofuran: 118 parts Image Bearing Member 3

Manufacture a laminate image bearing member having the electroconductive substrate 31, the undercoating layer 34, the charge generation layer 35, and the charge transport layer 36 in the same manner as in the case of the image bearing member 1.

Apply the liquid application 3 of the protection layer to the laminate image bearing member and dry it at 130° C. for 20 minutes to obtain an image bearing member 3 having the undercoating layer 34, the charge generation layer 35, the charge transport layer 36, and the surface protection layer 38 on the electroconductive substrate 31.

Liquid Application 3 of Protection Layer

Resin: phenolic resin (PR-50404, solid portion density: 80%, resin density: 1.4 g/cm$^3$, manufactured by SUMITOMO BAKELITE CO., LTD.): 12.5 parts Metal oxide filler: Titanium oxide (CR-EL, average particle diameter 0.25 μm, particle density: 4.3 g/cm$^3$, manufactured by ISHIHARA SANGYO KAISHA, LTD): 4 parts Solvent: Tetrahydrofuran: 118 parts Image Bearing Member 4

Manufacture a laminate image bearing member having the electroconductive substrate 31, the undercoating layer 34, the charge generation layer 35, and the charge transport layer 36 in the same manner as in the case of the image bearing member 1.

Apply the liquid application 4 of the protection layer to the laminate image bearing member and dry it at 130° C. for 20 minutes to obtain an image bearing member 4 having the undercoating layer 34, the charge generation layer 35, the charge transport layer 36, and the surface protection layer 38 on the electroconductive substrate 31.

Liquid Application 4 of Protection Layer

Resin: phenolic resin (PR-50404, solid portion density: 80%, resin density: 1.4 g/cm$^3$, manufactured by SUMITOMO BAKELITE CO., LTD.): 12.5 parts Metal oxide filler: zinc oxide (NanoTek Powder ZnO, average particle diameter 0.034 μm, particle density: 5.8 g/cm$^3$, manufactured by CI KASEI CO., LTD): 5.5 parts Solvent: Tetrahydrofuran: 118 parts Image Bearing Member 5

Manufacture a laminate image bearing member having the electroconductive substrate 31, the undercoating layer 34, the charge generation layer 35, and the charge transport layer 36 in the same manner as in the case of the image bearing member 1.

Next, apply the liquid application 5 of the protection layer to the laminate image bearing member by spray-coating followed by irradiation by a UV lamp (kind of valve: H valve, manufactured by Fusion UV Systems Japan KK.) under the condition of a lamp power output of 200 W/cm, an illuminance of 450 mW/cm$^2$, and an irradiation time of 30 seconds to conduct cross-linking.

Thereafter, dry it at 130° C. for 20 minutes to obtain an image bearing member 5 having the undercoating layer 34, the charge generation layer 35, the charge transport layer 36, and the surface protection layer 38 on the electroconductive substrate 31.

Liquid Application 5 of Protection Layer

Resin: acrylic monomer (hexane diol diacrylate, HDDA, molecular weight: 226, number of functional groups: 2, functional group equivalent molecular weight 113, resin density: 1.1 g/cm$^3$, manufactured by DAICEL-CYTEC Company LTD.): 10 parts Metal oxide filler zinc oxide (NanoTek Powder ZnO, average particle diameter: 0.034 μm, particle density: 5.8 g/cm$^3$, manufactured by CI KASEI CO., LTD): 10 parts Polymerization initiator: (1-hydroxy-cyclohexyl-phenyl-ketone (IRGACURE 184, manufactured by Chiba Specialty Chemicals, Ltd.): 0.5 parts Solvent: Tetrahydrofuran: 180 parts Image Bearing Members 6 to 20

Manufacture a laminate image bearing member having the electroconductive substrate 31, the undercoating layer 34, the charge generation layer 35, and the charge transport layer 36 in the same manner as in the case of the image bearing member 1.

Next, apply each liquid application of the protection layer shown in Table 1 to the laminate image bearing member by spray-coating followed by irradiation by a UV lamp (kind of valve: H valve, manufactured by Fusion UV Systems Japan KK.) under the condition of a lamp power output of 200 W/cm, an illuminance of 450 mW/cm$^2$, and an irradiation time of 30 seconds for the image bearing members 6 to 19 and 5 seconds for the image bearing member 20 to conduct cross-linking reaction.

Thereafter, day it at 130° C. for 20 minutes to obtain the image bearing members 6 to 20 having the undercoating layer 34, the charge generation layer 35, the charge transport layer 36, and the surface protection layer 38 on the electroconductive substrate 31.

With regard to the image bearing members 6 to 20, an acrylic monomer is used as the resin and the polymerization initiator is added in an amount of 5% to each addition amount of acrylic monomer.

The liquid application of protection layer is diluted by tetrahydrofuran in order that the solid portion density is about 10%.

The materials shown in Table 1 represent the following.

Resins

PC: Bisphenol Z polycarbonate (PanLite TS-2050, resin density: 1.2 g/cm$^3$, manufactured by Teijin Chemicals Ltd.)

PR-50404: phenolic resin (PR-50404, solid portion density: 80%, resin density: 1.4 g/cm$^3$, manufactured by SUMITOMO BAKELITE CO., LTD.)

ATM-35E: acrylic monomer (ethoxyfied pentaerythritol tetraacrylate, molecular weight: 1,892, number of functional groups: 4, functional group equivalent molecular weight: 473, resin density 1.1 g/cm$^3$, manufactured by SHIN-NAKAMURA CHEMICAL CO., LTD.)

HDDA: acrylic monomer (hexane diol diacrylate, HDDA, molecular weight: 226, number of functional groups: 2, functional group equivalent molecular weight: 113, resin density: 1.1 g/cm$^3$, manufactured by DAICEL-CYTEC Company LTD.)

SR355: acrylic monomer (di-trimethylol propane tetraacrylate, molecular weight: 466, number of functional groups: 4, functional group equivalent molecular weight: 117, resin density 1.1 g/cm$^3$, manufactured by SARTOMER COMPANY INC.)

DPHA: acrylic monomer (dipentaerythritol penta and hexa acrylate, M-402, molecular weight: 576, number of functional groups: 6, functional group equivalent molecular weight: 96, resin density 1.1 g/cm$^3$, manufactured by TOAGOSEI CO., LTD.)

Filler

Titanium oxide (CR-EL, average particle diameter 0.25 μm, particle density: 4.3 g/cm$^3$, manufactured by ISHIHARA SANGYO KAISHA, LTD)

Zinc oxide (NanoTek Powder ZnO, average particle diameter: 0.034 μm, particle density: 5.8 g/cm$^3$, manufactured by CI KASEI CO., LTD)

Alumina (NanoTek Powder $Al_2O_3$, average particle diameter 0.031 μm, particle density: 3.5 g/cm$^3$, manufactured by CI KASEI CO., LTD.)

Titanium oxide (NanoTek Powder Ti2O3, average particle diameter 0.036 μm, particle density: 3.7 g/cm$^3$, manufactured by CI KASEI CO., LTD.)

PT-501A: Titanium oxide (PT-501A, average particle diameter 0.1 μm, particle density: 3.9 g/cm$^3$, manufactured by ISHIHARA SANGYO KAISHA, LTD.)

Colloidal silica (SNOWTEX® OXS, average particle diameter 4 to 6 nm, particle density: 2.2 g/cm$^3$, solid portion concentration: 10%, manufactured by NISSAN CHEMICAL INDUSTRIES, LTD.)

Colloidal alumina (ALUMINASOL™ 520, average particle diameter: 10 nm to 20 nm, particle density: 3.5 g/cm$^3$, solid portion concentration: 20%, manufactured by NISSAN CHEMICAL INDUSTRIES, LTD.)

Silicone (non-metal metal oxide filler) (TOSPEARL® 103, average particle diameter: 300 nm, particle density: 1.3 g/cm$^3$, manufactured by Momentive Performance Materials Inc.)

In addition to the composition of the surface protection layer 38 of the image bearing members 1 to 20, the filler volume content rate and the surface hardness of the image bearing members 1 to 20 are shown in Table 1.

Calculation of Filler Volume Content Rate

The filler volume content rate in the surface protection layer 38 is calculated by observing the cross section of the protection layer as follows: The observation method is: Coat platinum paradium to a fraction of the image bearing member to impart electroconductivity followed by deposition by platinum carbon for surface protection to prepare an observation sample. Process the cross section thereof using a focused ion beam (FIB); Observe the obtained cross section by a thermal field emission scanning electron microscope (FE-SEM) with a magnification power of 10,000. The FIB instrument is Quanta 2000 3D (manufactured by FEI COMPANY JAPAN LTD.) and the thermal FE-SEM is ULTRA 55 (manufactured by CARL ZEISS).

Digitize the image data of the SEM image into the filler portion and the non-filler portion by using an image analysis software LMeye (manufactured by LASERTEC CORPORATION).

Calculate the area ratio of the digitized portions by the software to obtain S1/(S1+S2), where S1 represents the non-filler occupying area and S2 represents the filler occupying area. Conduct this process for ten SEM images and calculate the average thereof, which is determined as the filler volume content rate.

Measuring of Hardness

Measure the hardness of the image bearing member by using the following instrument under the following conditions:

Instrument: FISCHER SCOPE H-100 (manufactured by FISCHER INSTRUMENTS)

Maximum Test Load: 1 mN

Load Application Time: 30 seconds

Increase of Load: 1 mN/30 seconds

Creep at Maximum Test Load: 5 seconds

Decrease of Load: Same as Increase of Load

Creep after Discharging: 5 seconds

Indenter: SMC 117

TABLE 1

| Image bearing member | Resin | Filler | Surface hardness ($N/mm^2$) | Filler volume content rate (%) | Filler particle diameter (nm) | Acrylic monomer functional group equivalent molecular weight | Number of acrylic monomer functional group |
|---|---|---|---|---|---|---|---|
| Image bearing member 1 | *PC | CR-EL | 215 | 8 | 250 | — | |
| Image bearing member 2 | *PR-50404 | CR-EL | 305 | 8 | 250 | — | — |
| Image bearing member 3 | *PR-50404 | CR-EL | 305 | 15 | 250 | — | — |
| Image bearing member 4 | *PR-50404 | Zinc oxide | 305 | 15 | 34 | — | — |
| Image bearing member 5 | HDDA | Zinc oxide | 205 | 20 | 34 | 113 | 2 |
| Image bearing member 6 | ATM-35E | Zinc oxide | 210 | 20 | 34 | 473 | 4 |
| Image bearing member 7 | SR355 | Alumina | 260 | 8 | 31 | 117 | 4 |
| Image bearing member 8 | SR355 | Alumina | 265 | 42 | 31 | 117 | 4 |
| Image bearing member 9 | SR355 | Alumina | 260 | 11 | 31 | 117 | 4 |
| Image bearing member 10 | SR355 | Alumina | 265 | 38 | 31 | 117 | 4 |
| Image bearing member 11 | SR355 | Colloidal silica | 265 | 25 | 5 | 117 | 4 |
| Image bearing member 12 | SR355 | CR-EL | 265 | 25 | 250 | 117 | 4 |
| Image bearing member 13 | SR355 | Colloidal alumina | 265 | 25 | 10-20 | 117 | 4 |
| Image bearing member 14 | SR355 | PT-501A | 265 | 25 | 100 | 117 | 4 |
| Image bearing member 15 | SR355 | Zinc oxide | 265 | 25 | 34 | 117 | 4 |
| Image bearing member 16 | DPHA | Zinc oxide | 305 | 305 | 34 | 96 | 6 |
| Image bearing member 17 | SR355 | Alumina | 275 | 275 | 31 | 117 | 4 |
| Image bearing member 18 | DPHA | Titanium oxide | 270 | 270 | 36 | 96 | 6 |
| Image bearing member 19 | SR355 | Zinc oxide | 190 | 190 | 31 | 117 | 4 |
| Image bearing member 20 | SR355 | Silicone | 155 | 155 | 300 | 117 | 4 |

*other than acrylic monomer

Next, the cleaning blade 62 is described.

Prepare cleaning blades of the blades 1 to 29 by changing the material of the elastic blade 622, the material, the impregnation processing time, and the thickness of the mixed layer 62*d* of the substrate and acrylic and/or methacrylic resin, and the material and the thickness of the surface layer 623 of an acrylic resin and/or a methacrylic resin.

Elastic Blade

Prepare five kinds of urethane rubber having the following properties at 25° C. as the elastic blade 622.

Urethane rubber 1: hardness: 66 degree, impact resilience: 46%, manufactured by BANDO CHEMICAL INDUSTRIES, LTD.

Urethane rubber 2: hardness: 70 degree, impact resilience: 50%, manufactured by TOYO TYRE AND RUBBER CO., LTD.

Urethane rubber 3: hardness: 72 degree, impact resilience: 31%, manufactured by TOYO TYRE AND RUBBER CO., LTD.

Urethane rubber 4: hardness: 75 degree, impact resilience: 21%, manufactured by TOYO TYRE AND RUBBER CO., LTD.

Urethane rubber 5: hardness: 77 degree, impact resilience: 19%, manufactured by SYNZTEC CO., LTD.

The urethane rubber is measured by a durometer manufactured by Shimadzu Corporation based on JIS K6253.

Prepare a sample by laminating sheets having a thickness of about 2 mm in order that the thickness is 12 mm or more.

The impact resilience of the urethane rubber is measured by a No. 221 resilience tester (manufactured by TOYO SEIKI KOGYO CO., LTD.) based on JIS K6255. Prepare a sample by laminating sheets having a thickness of about 2 mm in order that the thickness is 4 mm or more.

Prepare the reed-like elastic blade 622 having a thickness of 1.8 mm using the urethane rubber; Subsequent to the following treatment to the elastic blade 622, laminate the mixed layer 62*d* of the substrate and acrylic and/or methacrylic resin and the surface layer 623 of acrylic and/or methacrylic resin.

Material for Mixed Layer

Impregnate the elastic blade 622 serving as the substrate with the material for the mixed layer for a predetermined time to manufacture the mixed layer 62*d* of substrate and an acrylic resin and/or a methacrylic resin.

The cross-linking reaction is conducted by applying thermal and optical energy after coating the acrylic and/or methacrylic resin surface layer.

Material 1 for Mixed Layer

Monomer: PETIA (manufactured by DAICEL-CYTEC Company LTD.): 10 parts

Polymerization Initiator: IRGACURE 184 (manufactured by Ciba Inc.): 1 part

Solvent: tetrahydrofuran: 149 parts

Material 2 for Mixed Layer

Monomer 1: PETIA (manufactured by DAICEL-CYTEC Company LTD.): 9 parts

Monomer 2: HDDA (manufactured by DAICEL-CYTEC Company LTD.): 1 part

Polymerization Initiator: IRGACURE 184 (manufactured by Ciba Inc.): 1 part

Solvent tetrahydrofuran: 149 parts

Material 3 for Mixed Layer

Monomer: DPHA (manufactured by DAICEL-CYTEC Company LTD.): 10 parts

Polymerization Initiator: IRGACURE 184 (manufactured by Ciba Inc.): 1 part

Solvent: tetrahydrofuran: 149 parts

Material 4 for Mixed Layer

Monomer: DPCA-120 (manufactured by NIPPON KAYAKU CO., LTD.): 10 pats

Polymerization Initiator: IRGACURE 184 (manufactured by Ciba Inc.): 1 part

Solvent: Tetrahydrofuran: 149 parts

Material 5 for Mixed Layer

Monomer 1: (Sumidul HT (HDI adduct) (manufactured by SUMITOMO CHEMICAL BAYER CO., LTD.) 8 parts Monomer 2: Polyol represented by the following Chemical Structure 2 (manufactured by KANTO CHEMICAL CO., INC.) 2 parts Chemical Structure 2

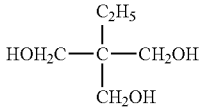

Solvent: Tetrahydrofuran: 110 parts

Material for Blade Surface Layer

Apply the following material for the surface layer to the surface of the mixed layer 62*d* of the substrate and acrylic and/or methacrylic resin by a spray coating method to form the surface layer 623 of acrylic and/or methacrylic resin.

With regard to the materials 1 to 4 for the surface layer, conduct optical cross-linking reaction by ultraviolet irradiation.

With regard to the material 5 for the surface layer, conduct thermal cross-linking reaction by heating. Control the spray coating conditions (amount and speed of application) to obtain a surface layer having a predetermined thickness.

Material 1 for Surface Layer

Monomer: PETIA (manufactured by DAICEL-CYTEC Company LTD.): 10 parts

Polymerization Initiator: IRGACURE 184 (manufactured by Ciba Inc.): 1 part

Solvent: 2-butanone: 89 parts

Material 2 for Surface Layer

Monomer 1: PETIA (manufactured by DAICEL-CYTEC Company LTD.): 9 parts

Monomer 2: HDDA (manufactured by DAICEL-CYTEC Company LTD.): 1 part

Polymerization Initiator: IRGACURE 184 (manufactured by Ciba Inc.): 1 part

Solvent: 2-butanone: 89 parts

Material 3 for Surface Layer

Monomer: DPHA (manufactured by DAICEL-CYTEC Company LTD.): 10 parts

Polymerization Initiator: IRGACURE 184 (manufactured by Cibe Inc.): 1 part

Solvent: 2-butanone: 89 parts

Material 4 for Surface Layer

Monomer: DPCA-120 (manufactured by NIPPON KAYAKU CO., LTD.): 10 parts

Polymerization Initiator: IRGACURE 184 (manufactured by Cibe Inc.): 1 part

Solvent: 2-butanone: 89 parts

Material 5 for Surface Layer

Monomer 1: (Sumidul HT (HDI adduct) (manufactured by SUMITOMO CHEMICAL BAYER CO. LTD.)

Monomer 2: Polyol represented by the Chemical Structure 1 illustrated above (manufactured by KANTO CHEMICAL CO., INC.): 2 parts Solvent: 2-butanone: 70 parts Optical Cross-Linking Condition UV irradiation: Metal hallide lamp (manufactured by USHIO INC.)

Irradiation Intensity: 500 mW/cm$^2$ (365 nm)

Distance between UV lamp and blade: 100 mm

Irradiation time: 60 seconds

Thermal Cross-Linking Condition

Heating Temperature: 150° C.

Heating Time: 20 minutes

The conditions for the manufactured blades 1 to 29 are shown in Table 2

TABLE 2

| Blade | Base blade | Mixed layer Material | Mixed layer Time (s) | Mixed layer Thickness (μm) | Surface layer Material | Surface layer Thickness (μm) |
|---|---|---|---|---|---|---|
| Blade 1 | 2 | 1 | 5 | 5 | 1 | 0.8 |
| Blade 2 | 2 | 1 | 8 | 9 | 1 | 0.8 |
| Blade 3 | 2 | 1 | 11 | 11 | 1 | 0.8 |
| Blade 4 | 2 | 1 | 20 | 15 | 1 | 0.8 |
| Blade 5 | 2 | 1 | 30 | 20 | 1 | 0.8 |
| Blade 6 | 2 | 1 | 55 | 29 | 1 | 0.8 |
| Blade 7 | 2 | 1 | 75 | 32 | 1 | 0.8 |
| Blade 8 | 2 | 1 | 120 | 41 | 1 | 0.8 |
| Blade 9 | 2 | 1 | 1800 | 92 | 1 | 0.8 |
| Blade 10 | 2 | 1 | 3600 | 103 | 1 | 0.8 |
| Blade 11 | 1 | 1 | 30 | 20 | 1 | 0.8 |
| Blade 12 | 3 | 1 | 30 | 20 | 1 | 0.8 |
| Blade 13 | 4 | 1 | 30 | 20 | 1 | 0.8 |
| Blade 14 | 5 | 1 | 30 | 20 | 1 | 0.8 |
| Blade 15 | 3 | 1 | 30 | 20 | 1 | 0.4 |
| Blade 16 | 3 | 1 | 30 | 20 | 1 | 0.6 |
| Blade 17 | 3 | 1 | 30 | 20 | 1 | 0.9 |
| Blade 18 | 3 | 1 | 30 | 20 | 1 | 1.2 |
| Blade 19 | 3 | 2 | 30 | 20 | 2 | 0.8 |
| Blade 20 | 3 | 3 | 30 | 15 | 3 | 0.8 |
| Blade 21 | 3 | 4 | 30 | 15 | 4 | 0.8 |
| Blade 22 | 3 | 3 | 30 | 15 | 1 | 0.8 |
| Blade 23 | 3 | 5 | 30 | 30 | 5 | 0.8 |
| Blade 24 | 2 | 1 | 30 | 20 | 1 | 0.05 |
| Blade 25 | 2 | 1 | 0 | 0.2 | 1 | 0.8 |
| Blade 26 | 3 | 1 | 30 | 20 | 1 | 0.05 |
| Blade 27 | 3 | 1 | 0 | 0.2 | 1 | 0.8 |
| Blade 28 | 2 | — | — | — | — | — |
| Blade 29 | 3 | — | — | — | — | — |

The structure of the image forming apparatus for use in a verification test is described next.

Fix the manufactured blade (blades 1 to 29) to a plate holder that can be mounted to a color multi-functional machine (imagio MP C4500, manufactured by RICOH CO., LTD.) by an adhesive to prepare sample cleaning blades.

Mount this to the color multi-functional machine (imagio MP C4500). Each cleaning blade is attached with a linear pressure of 20 g/cm and a cleaning angle of 79°.

Manufacture image forming apparatuses of Examples 1 to 42 and Comparative Examples 1 to 8 by mounting combinations of the image bearing members 1 to 20 and the blades 1 to 29.

Conduct machine tests using these image forming apparatuses under the following conditions.

Use polymerized toner for the verification test. Manufacture two kinds of toner containing different external additives based on mother toner particles having a circularity of 0.98 and an average particle diameter of 4.9 μm.

Toner Manufacturing Example 1

Add 1.5 parts of hydrophobic silica having a hydrophobicity of 65% and an average primary particle diameter of 140 nm, which is surface-treated by hexamethyl disilazane, to 100 parts of the obtained mother toner particles followed by mixing by a HENSCHEL MIXER (manufactured by NIPPON COKE & ENGINEERING. CO. LTD.) at a peripheral speed of 33 m/s for three minutes.

Screen the powder with a mesh having an opening of 38 μm after mixing and remove coarse particles to prepare toner 1 to which hydrophobized silica is externally added.

Toner Manufacturing Example 2

Add 1.5 parts of non-surface-treated silica having an average primary particle diameter of 140 nm to 100 parts of the obtained mother toner particles followed by mixing by a HENSCHEL MIXER (manufactured by NIPPON COKE & ENGINEERING. CO., LTD.) at a peripheral speed of 33 m/s for three minutes.

Screen the powder with a mesh having an opening of 38 μm after mixing and remove coarse particles to prepare toner 2 to which non-surface-treated silica is externally added.

The verification test is conducted under the following condition:

Laboratory environment: 30° C., 90% RH

Paper passing condition: Chart having an image area ratio of 5%.

Print images on 100,000 A4 sheets (landscape) in black.

The evaluation items are as follows:

Blade Edge Abrasion Width

Figure 6:
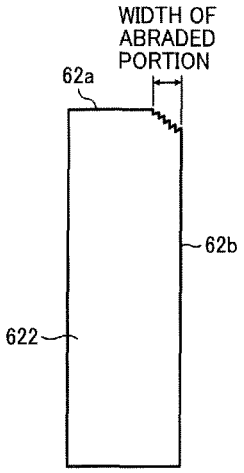
FIG. 6 is a schematic diagram illustrating the measured points about the abrasion width of the elastic blade.
Figure 7A:
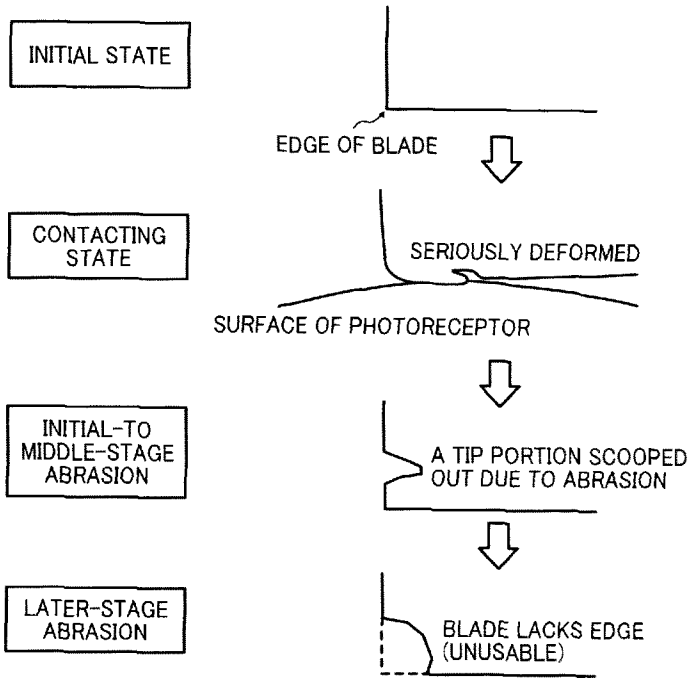
FIGS. 7A and 7 B are diagrams illustrating a comparison between an example of the elastic blade of the present disclosure and a typical elastic blade.
Figure 7B:
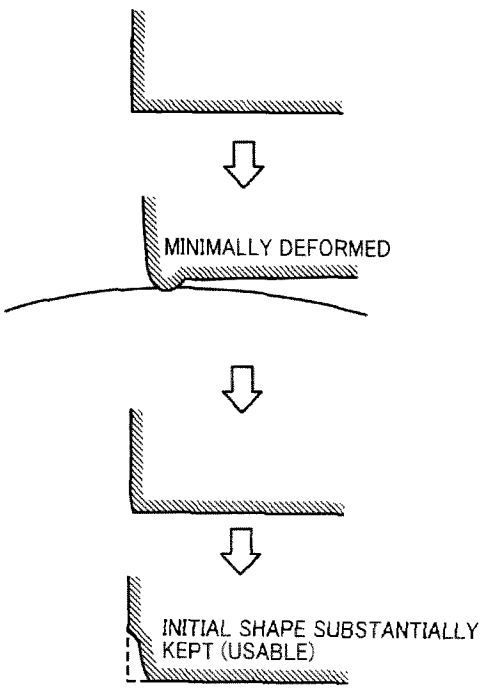
Figure 8A:
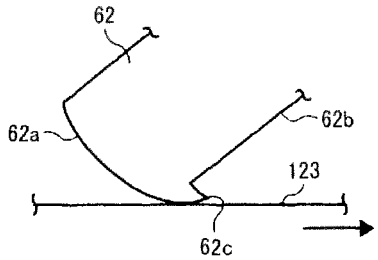
FIGS. 8A, 8B, and 8C are diagrams illustrating the front edge portion of the cleaning blade that is turning inward (or outward), disproportional local abrasion of the front edge surface of the cleaning blade, and the cleaning blade from which the front edge portion chips off, respectively.
Figure 8B:
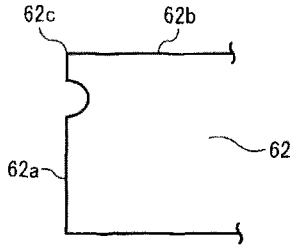
Figure 8C:
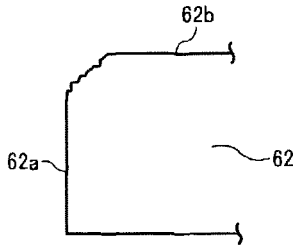

As illustrated in FIG. 6, measure the abrasion width from the front end of the blade. Observe the blade using a confocal microscope (OPTELICS H1200, manufactured by LASERTEC CORPORATION) under the following conditions.

Measuring mode: MAX Peak

Lens magnification power: objective lens: 50×

Color: MIX

Measuring of Abrasion Amount

Take out the image bearing member after the sheet-passing test and measure the abrasion amount from the difference in the thickness of the image bearing member between before and after the machine running test.

The thickness of the layer is measured by an eddy current layer thickness measuring meter (Fischer Scope MMS, manufactured by Fischer Instruments K.K.).

Evaluation of Amount of Toner that has Slipped Through

After the machine running test, conduct another machine running test with a run length of 100 sheets with an image ratio of 5% under the same condition as described above.

Output a solid chart after the 100 sheet, adjust the density of the chart measured by X-Rite 938 (manufactured by X-RITE CORPORATION) to be around 1.4.

Attach a toner catcher (DYNEEMA ND-200, manufactured by TOYOBO CO., LTD.) formed of polyethylene fiber to somewhere downstream from the cleaning blade to catch tone that has slipped through the cleaning portion.

Output a solid image on 10 sheets, determine the toner caught by the toner catcher as the toner that has slipped-through, quantify this amount of toner for evaluation of the cleaning property.

Quantify the toner that has slipped through by the following image processing: Take in the toner catcher by a scanner (EPSON ES-8500) in 24 bit color and 600 dpi.

Digitize the taken-in image by LMeye (manufactured by LASERTEC CORPORATION) followed by image processing and calculate the brightness data of the toner and the toner area in the toner catcher.

Quantify the amount of the toner in the toner catcher from these data as the toner that has slipped through.

The smaller this value, the better the toner cleaning property.

Evaluation on Filming Resistance of Image Bearing Member

Evaluate the filming resistance by observing the image bearing member after the machine running test.

Observe the blade using a confocal microscope (OPTELICS H1200, manufactured by LASERTEC CORPORATION) under the following conditions.

Measuring mode: MAX Peak

Lens magnification power: objective lens: 5×

Color: MIX

Using the observation results, evaluate the filming resistance of the image bearing member. Rank 2 or higher is free from practical problems.

3: No filming observed

2: Slight Filming observed

1: Filming observed in wider area

Evaluation on Abnormal Noise

Confirm whether abnormal noises caused by vibration of the cleaning blade are heard during the machine running test.

Table 3 shows the results of the verification test of Examples 1 to 42 and Comparative Examples 1 to 8.

TABLE 3

| Example | Image bearing member | Blade | Toner | Abrasion amount of image bearing member (μm) |
|---|---|---|---|---|
| Example 1 | Image bearing member 1 | Blade 1 | Toner 2 | 0.8 |
| Example 2 | Image bearing member 2 | Blade 1 | Toner 2 | 0.7 |
| Example 3 | Image bearing member 3 | Blade 1 | Toner 2 | 0.7 |
| Example 4 | Image bearing member 4 | Blade 1 | Toner 2 | 0.6 |
| Example 5 | Image bearing member 5 | Blade 1 | Toner 2 | 0.7 |
| Example 6 | Image bearing member 6 | Blade 1 | Toner 2 | 0.7 |
| Example 7 | Image bearing member 7 | Blade 2 | Toner 2 | 0.4 |
| Example 8 | Image bearing member 8 | Blade 2 | Toner 2 | 0.4 |
| Example 9 | Image bearing member 9 | Blade 2 | Toner 2 | 0.2 |
| Example 10 | Image bearing member 10 | Blade 2 | Toner 2 | 0.2 |
| Example 11 | Image bearing member 11 | Blade 2 | Toner 2 | 0.3 |
| Example 12 | Image bearing member 12 | Blade 2 | Toner 2 | 0.2 |
| Example 13 | Image bearing member 13 | Blade 2 | Toner 2 | 0.2 |
| Example 14 | Image bearing member 14 | Blade 2 | Toner 2 | 0.3 |
| Example 15 | Image bearing member 15 | Blade 2 | Toner 2 | 0.2 |
| Example 16 | Image bearing member 16 | Blade 3 | Toner 2 | 0.3 |
| Example 17 | Image bearing member 17 | Blade 4 | Toner 2 | 0.2 |
| Example 18 | Image bearing member 18 | Blade 1 | Toner 2 | 0.3 |
| Example 19 | Image bearing member 18 | Blade 2 | Toner 2 | 0.2 |
| Example 20 | Image bearing member 18 | Blade 3 | Toner 2 | 0.3 |
| Example 21 | Image bearing member 18 | Blade 4 | Toner 2 | 0.2 |
| Example 22 | Image bearing member 18 | Blade 5 | Toner 2 | 0.2 |
| Example 23 | Image bearing member 18 | Blade 6 | Toner 2 | 0.2 |
| Example 24 | Image bearing member 18 | Blade 7 | Toner 2 | 0.2 |
| Example 25 | Image bearing member 18 | Blade 8 | Toner 2 | 0.2 |
| Example 26 | Image bearing member 18 | Blade 9 | Toner 2 | 0.3 |
| Example 27 | Image bearing member 18 | Blade 10 | Toner 2 | 0.2 |
| Example 28 | Image bearing member 18 | Blade 11 | Toner 2 | 0.2 |
| Example 29 | Image bearing member 18 | Blade 12 | Toner 2 | 0.2 |
| Example 30 | Image bearing member 18 | Blade 13 | Toner 2 | 0.3 |
| Example 31 | Image bearing member 18 | Blade 14 | Toner 2 | 0.3 |
| Example 32 | Image bearing member 18 | Blade 15 | Toner 2 | 0.3 |
| Example 33 | Image bearing member 18 | Blade 16 | Toner 2 | 0.2 |
| Example 34 | Image bearing member 18 | Blade 17 | Toner 2 | 0.2 |
| Example 35 | Image bearing member 18 | Blade 18 | Toner 2 | 0.2 |
| Example 36 | Image bearing member 18 | Blade 19 | Toner 2 | 0.3 |
| Example 37 | Image bearing member 18 | Blade 20 | Toner 2 | 0.2 |
| Example 38 | Image bearing member 18 | Blade 21 | Toner 2 | 0.3 |
| Example 39 | Image bearing member 18 | Blade 22 | Toner 2 | 0.3 |
| Example 40 | Image bearing member 18 | Blade 23 | Toner 2 | 0.2 |
| Example 41 | Image bearing member 15 | Blade 2 | Toner 1 | 0.2 |
| Example 42 | Image bearing member 16 | Blade 2 | Toner 1 | 0.2 |
| Comparative Example 1 | Image bearing member 15 | Blade 24 | Toner 2 | * |
| Comparative Example 2 | Image bearing member 15 | Blade 25 | Toner 2 | * |
| Comparative Example 3 | Image bearing member 15 | Blade 26 | Toner 2 | * |
| Comparative Example 4 | Image bearing member 15 | Blade 27 | Toner 2 | * |
| Comparative Example 5 | Image bearing member 15 | Blade 28 | Toner 2 | * |
| Comparative Example 6 | Image bearing member 15 | Blade 29 | Toner 2 | * |
| Comparative Example 7 | Image bearing member 19 | Blade 2 | Toner 2 | 1.5 |
| Comparative Example 8 | Image bearing member 20 | Blade 2 | Toner 2 | 2.7 |

| Example | Amount of toner that has slipped through | Blade edge abrasion width (μm) | Filming resistance | Abnormal noise |
|---|---|---|---|---|
| Example 1 | 40 | 8.9 | 2 | None |
| Example 2 | 45 | 7.2 | 2 | None |
| Example 3 | 25 | 6.1 | 2 | None |
| Example 4 | 15 | 6.9 | 2 | None |
| Example 5 | 20 | 7.6 | 2 | None |
| Example 6 | 10 | 6.9 | 2 | None |
| Example 7 | 40 | 4.1 | 2 | None |
| Example 8 | 45 | 5 | 2 | None |
| Example 9 | 35 | 4.4 | 2 | None |
| Example 10 | 30 | 3.2 | 2 | None |
| Example 11 | 45 | 4.7 | 2 | None |
| Example 12 | 40 | 3.3 | 2 | None |
| Example 13 | 30 | 4.4 | 2 | None |
| Example 14 | 25 | 2.8 | 2 | None |
| Example 15 | 10 | 2.2 | 2 | None |
| Example 16 | 5 | 1.7 | 3 | None |
| Example 17 | 5 | 1.8 | 3 | None |
| Example 18 | 20 | 6.6 | 2 | None |
| Example 19 | 15 | 3.8 | 2 | None |
| Example 20 | 5 | 1.9 | 3 | None |
| Example 21 | 5 | 1.9 | 3 | None |
| Example 22 | 5 | 1.8 | 3 | None |
| Example 23 | 5 | 1.7 | 3 | None |
| Example 24 | 10 | 2.6 | 2 | None |
| Example 25 | 15 | 3.9 | 2 | None |
| Example 26 | 20 | 8.8 | 2 | None |
| Example 27 | 10 | 3.4 | 2 | None |
| Example 28 | 5 | 1.4 | 3 | None |
| Example 29 | 5 | 2.1 | 3 | None |
| Example 30 | 5 | 2.1 | 3 | None |
| Example 31 | 5 | 2.0 | 3 | None |
| Example 32 | 20 | 4.3 | 2 | None |
| Example 33 | 5 | 1.8 | 3 | None |
| Example 34 | 5 | 2.0 | 3 | None |
| Example 35 | 20 | 3.6 | 2 | None |
| Example 36 | 5 | 1.8 | 3 | None |
| Example 37 | 5 | 1.7 | 3 | None |
| Example 38 | 5 | 2.1 | 3 | None |
| Example 39 | 5 | 2.0 | 3 | None |
| Example 40 | 5 | 2.1 | 3 | None |

TABLE 3-continued

| | | | | |
|---|---|---|---|---|
| Example 41 | 5 | 1.6 | 3 | None |
| Example 42 | 5 | 1.9 | 3 | None |
| Comparative Example 1 | 130 | 123 | 1 | Abnormal noise |
| Comparative Example 2 | 60 | 33.9 | 1 | None |
| Comparative Example 3 | 110 | 181 | 1 | Abnormal noise |
| Comparative Example 4 | 70 | 43.1 | 1 | None |
| Comparative Example 5 | 130 | 225 | 1 | Abnormal noise |
| Comparative Example 6 | 140 | 174 | 1 | Abnormal noise |
| Comparative Example 7 | 95 | 15.6 | 3 | None |
| Comparative Example 8 | 110 | 27.7 | 3 | None |

* Filming occurs and layer thickness increases

As seen in the results of the image forming apparatuses of Examples 1 to 42 having the image bearing member having the surface protection layer 38 and the cleaning blade 62 having the front edge portion having the laminate structure described above, good cleaning property is sustained with time.

In addition, abnormal noises are not heard with time.

It is also possible to reduce the abrasion of the image bearing member and the cleaning blade and occurrence of filming.

On the other hand, as seen in the results of Comparative Examples 1 to 8, the cleaning blade is not suitable in terms of the toner that has slipped through, the blade abrasion, and the filming of the image bearing member.

In addition, the image bearing members of Comparative Examples 7 and 8 have a low surface hardness and the abrasion amount of the image bearing member increases.

The surface of the image bearing member is scarred, thereby increasing the slipping-through toner and the abrasion of the cleaning blade.

What is described above is just an example and the present invention is not limited thereto.

Other specific examples are as follows:

Example A

In an image forming apparatus having the image bearing member 3 and the reed-like elastic blade 622 with the front edge portion of the cleaning blade 62 that is brought into contact with the moving surface of the image bearing member to remove toner from the surface of the image bearing member, the image bearing member 3 contains fillers made of a metal oxide and has a surface layer having a surface hardness of 200 N/mm$^2$ or higher.

The front edge portion of the cleaning blade has a laminate structure formed of the substrate of the elastic blade, the mixed layer 62*d* of the substrate and acrylic and/or methacrylic resin, which has a thickness of 1.0 μm or greater, and the surface layer 623 of acrylic and/or methacrylic resin, which has a thickness of 0.1 μm or greater.

By having such a structure, as described above, the contact between the front edge portion of the cleaning blade and the image bearing member is kept good, thereby keeping the cleaning property good.

In addition, it is possible to reduce abnormal abrasion of the image bearing member and the cleaning blade, occurrence of abnormal noise, and turning inward or outward of the front edge portion of the cleaning blade.

Furthermore, filming on the image bearing member decreases.

Example B

The image forming apparatus of Example B has the same structure as Example A with fillers of metal oxide contained in the surface layer of the image bearing member, which has a volume content rate of from 10% to 40%. By having such a structure, as described above, the surface of the image bearing member has roughness that improves the surface hardness and provides good cleaning property.

When the volume content rate of the filler is too small, the obtained surface hardness is not high or the roughness of the surface of the image bearing member is not formed.

Consequently, the abrasion of the image bearing member is promoted and cleaning performance deteriorates.

When the volume content rate of the filler is too high, the roughness of the surface of the image bearing member tends to increase excessively, so that the front edge portion of the cleaning blade is not held on the surface of the image bearing member 3 stably, thereby degrading cleaning performance.

Example C

The image forming apparatus of Example C has the same structure as Example A or Example B with fillers of metal oxide contained in the surface layer of the image bearing member, which has a particle diameter of from 10 nm to 100 nm. By having such a structure, as described above, the surface of the image bearing member has roughness that improves the surface hardness and provides good cleaning property.

When the particle diameter of the filler is too small, the obtained surface hardness tends to be insufficient or the roughness of the surface of the image bearing member is not formed.

Consequently, the abrasion of the image bearing member is promoted and cleaning performance deteriorates.

When the particle diameter of the filler is too large, the roughness of the surface of the image bearing member tends to increase excessively, so that the front edge portion of the cleaning blade may not be held on the surface of the image bearing member 3 stably, thereby degrading cleaning performance.

Example D

The image forming apparatus of Example D has the same structure as Example A, Example B, or Example C with the surface layer of the image bearing member formed of a curable resin using an acrylic monomer having a functional group equivalent molecular weight of 350 or less and three or more functional groups.

By having such a structure, as described above, a three dimensional network structure is developed, thereby providing the surface protection layer with a high hardness with an extremely high density and a high elasticity.

In addition, the layer exhibits a high abrasion resistance and damage resistance.

Example E

The image forming apparatus of Example E has the same structure as Example A, Example B, Example C, or Example D with the surface layer 623 of acrylic and/or methacrylic resin of the cleaning blade, which has a thickness of from 0.5 μm to 1.0 μm.

By having such a structure, as described above, the cleaning property is kept good.

In addition, it is possible to reduce abnormal abrasion of the image bearing member and the cleaning blade, occurrence of abnormal noise, and turning inward or outward of the front edge portion of the cleaning blade.

When the thickness of the surface layer is too thin, the durability of the cleaning blade 62 tends to be insufficient.

When the thickness of the surface layer is too thick, problems such as the turning inward or outward of the front edge portion of the blade and cracking tend to occur.

Example F

The image forming apparatus of Example F has the same structure as Example A, Example B, Example C, Example D, or Example E with the mixed layer 62*d* of the substrate and acrylic and/or methacrylic resin, which has a thickness of from 10 μm to 30 μm.

By having such a structure, as described above, the cleaning property is kept good.

In addition, it is possible to reduce abnormal abrasion of the image bearing member and the cleaning blade, occurrence of abnormal noise, and turning inward or outward of the front edge portion of the cleaning blade.

When the mixed layer is too thin, the durability of the cleaning blade 62 tends to be insufficient.

When the thickness of the mixed layer is too thick, problems such as the turning inward or outward of the front edge portion of the blade and cracking tend to occur.

Example G

The image forming apparatus of Example G has the same structure as Example A, Example B, Example C, Example D. Example E, or Example F and hydrophobized silica particles are externally added to the toner.

By having such a structure, as described above, the fluidity and the chargeability are improved, which contributes to producing quality images and in addition the cleaning property of the toner is improved.

On the other hand, there is a concern that the silica particles cause filming on the image bearing member.

However, occurrence of the filming on the image bearing member is reduced by the structure of this Example.

Example H

Example H is a process cartridge detachably attachable to an image forming apparatus and is integrally formed of the image bearing member and the cleaning blade employed in any of the image forming apparatus of Example A. Example B, Example C, Example D, Example E, Example F, or Example G. By providing such a process cartridge, as described above, the cleaning property is kept good over an extended period of time and it is possible to reduce abnormal abrasion of the image bearing member and the cleaning blade, occurrence of abnormal noise, and turning inward or outward of the front edge portion of the cleaning blade.

In addition, the filming on the surface of the image bearing member is also reduced.

What is claimed is:

1. An image forming apparatus comprising:

an image bearing member comprising a surface layer A having a surface hardness of 200 N/mm$^2$ or greater, the surface layer A comprising fillers made of a metal oxide; and a cleaning blade comprising a reed-like elastic blade having a front edge portion to remove toner from the surface layer A in motion while the front edge portion is in contact with the surface layer A, the front edge portion having a laminate structure formed of a substrate of the elastic blade;

a mixed layer of the substrate and an acrylic and/or methacrylic resin, the mixed layer having a thickness of 1.0 μm or greater; and a surface layer B having an acrylic and/or methacrylic resin, the surface layer B having a thickness of 0.1 μm or greater.

2. The image forming apparatus according to claim 1, wherein the fillers in the surface layer A have a volume content rate of from 10% to 40%.

3. The image forming apparatus according to claim 1, wherein the fillers have a particle diameter of from 10 nm to 100 nm.

4. The image forming apparatus according to claim 1, wherein the surface layer A comprises a cured resin formed by using an acrylic monomer having a functional group equivalent molecular weight of 350 or less and three or more functional groups.

5. The image forming apparatus according to claim 1, wherein the surface layer B has a thickness of from 0.5 μm to 1.0 μm.

6. The image forming apparatus according to claim 1, wherein the mixed layer has a thickness of from 10 μm to 30 μm.

7. The image forming apparatus according to claim 1, wherein hydrophobized silica particles are externally added to the toner.

8. A process cartridge detachably attachable to an image forming apparatus comprising:

an image bearing member comprising a surface layer A having a surface hardness of 200 N/mm$^2$ or greater, the surface layer A comprising fillers made of a metal oxide, and a cleaning blade comprising a reed-like elastic blade having a front edge portion to remove toner from the surface layer A in motion while contacting the front edge portion with the surface layer A, the front edge portion having a laminate structure formed of:

a base material of the elastic blade;

a mixed layer of the based material and an acrylic and/or methacrylic resin, the mixed layer having a thickness of 1.0 μm or greater; and a surface layer B having an acrylic and/or methacrylic resin, the surface layer B having a thickness of 0.1 μm or greater.

* * * * *